US009303364B2

(12) United States Patent
Madderom et al.

(10) Patent No.: US 9,303,364 B2
(45) **Date of Patent: *Apr. 5, 2016**

(54) RAIL CANT MEASUREMENT TOOL AND METHOD

(71) Applicant: Holland, L.P., Crete, IL (US)

(72) Inventors: Robert N. Madderom, Mokena, IL (US); Harold T. Ruggles, Merrillville, IN (US); Stefan T. Pendrick, Hammond, IN (US); Brandon R. Huynh, Dyer, IN (US)

(73) Assignee: Holland, L.P., Crete, IL (US)

( * ) Notice: Subject to any disclaimer, the term of this patent is extended or adjusted under 35 U.S.C. 154(b) by 100 days.

This patent is subject to a terminal disclaimer.

(21) Appl. No.: 14/257,148

(22) Filed: Apr. 21, 2014

(65) Prior Publication Data

US 2014/0325857 A1 Nov. 6, 2014

Related U.S. Application Data

(63) Continuation-in-part of application No. 13/614,024, filed on Sep. 13, 2012, now Pat. No. 8,844,149.

(60) Provisional application No. 61/813,986, filed on Apr. 19, 2013.

(51) Int. Cl.
*E01B 35/00* (2006.01)
*E01B 35/02* (2006.01)
*B61K 9/08* (2006.01)

(52) U.S. Cl.
CPC .. *E01B 35/00* (2013.01); *B61K 9/08* (2013.01)

(58) Field of Classification Search
CPC ..... B61K 9/08
USPC ..... 33/1 Q, 338, 521, 523.1, 533
See application file for complete search history.

(56) References Cited

U.S. PATENT DOCUMENTS

| | | | | | |
|---|---|---|---|---|---|
| 926,770 | A * | 7/1909 | Prather | 33/338 | |
| 1,329,197 | A * | 1/1920 | Matoba | E01B 35/02 | 33/338 |
| 1,410,491 | A * | 3/1922 | Matoba | E01B 35/02 | 33/338 |
| 1,601,261 | A * | 9/1926 | Prather | G01B 5/255 | 33/335 |
| 5,025,566 | A * | 6/1991 | Fiechter | E01B 35/02 | 33/338 |
| 5,036,594 | A * | 8/1991 | Kesler | E01B 35/02 | 104/7.2 |
| 5,189,798 | A * | 3/1993 | La Force | G01B 5/25 | 33/1 Q |
| 5,519,944 | A * | 5/1996 | Delastre | G01B 7/345 | 33/1 Q |
| 5,660,470 | A * | 8/1997 | Mench | G01J 5/041 | 246/169 D |
| 5,720,110 | A * | 2/1998 | Heckmann | B60L 5/38 | 33/1 Q |
| 6,119,353 | A * | 9/2000 | Grønskov | E01B 35/12 | 33/1 Q |
| 6,564,467 | B1 * | 5/2003 | Kay | B61K 9/12 | 246/169 R |
| 8,844,149 | B2 * | 9/2014 | Madderom | E01B 35/00 | 33/338 |
| 2002/0083607 | A1 * | 7/2002 | Atsuhiko | G01B 5/285 | 33/553 |
| 2014/0318407 | A1 * | 10/2014 | Ibanez Latorre | E01B 27/17 | 104/7.1 |

* cited by examiner

*Primary Examiner* — G. Bradley Bennett
(74) *Attorney, Agent, or Firm* — Scherrer Patent & Trademark Law, P.C.; Stephen T. Scherrer; Monique A. Morneault

(57) ABSTRACT

Rail cant measurement tools and associated methods enable users to measure rail cant. The measurement tools comprise a reference assembly, and a cant angle measurement assembly. The reference assembly comprises a track plane reference bar, a rail centerline reference head, and a measurement gauge for measuring rail cant.

20 Claims, 20 Drawing Sheets

RAIL CANT MEASUREMENT TOOL AND METHOD

The present invention claims priority under 35 U.S.C. 119 to U.S. Provisional Patent Application No. 61/813,986, titled "Rail Cant Measurement Tool and Method," filed Apr. 19, 2014, which is expressly incorporated herein by reference in its entirety. The present application further claims the benefit as a continuation-in-part application of U.S. patent application Ser. No. 13/614,024, entitled "Rail Cant Measurement Tool and Method," filed Sep. 13, 2012, which claims priority under 35 U.S.C. 119 to U.S. Provisional Pat. App. No. 61/573,818, entitled "Rail Cant Measurement Tool and Method," filed Sep. 13, 2011, each of which is expressly incorporated herein by reference in its entirety.

TECHNICAL FIELD

The present invention relates generally to measurement tools for use in the rail industry. More particularly, the present invention relates to measurement tools for measuring the cant of rail, or rail cant measurement tools.

BACKGROUND

It is, of course, generally known to measure rail cant of parallel adjacent rails in a railway. Rail cant is measured relative to the plane established by the top of the adjacent rails in track. Rail is typically installed in track on an inward inclination of 1:40 (1.43 degrees) for the purpose of best wheel-to-rail contact. Over time, track degrades because of train loadings, and thus the inclination of the rail readily changes due to various causes stemming from said loadings. In other words, rail cant can change, either inward or outward with the passing of train traffic.

Track measurement vehicles, known as geometry cars, commonly measure existing rail cant and have capability to identify variation from design. These geometry cars use optical measurement systems that have been calibrated to report rail cant accurately. Rail cant exceptions (variation from design beyond defined thresholds) are reported by location and magnitude so that track repair crews can make maintenance corrections.

Track measurement crews need rugged, easy to use measurement tools to manually measure track and rail condition as they do their maintenance work. No tool currently exists to measure rail cant (relative to top of track plane). Therefore, track crews do not have a simple and accurate means to confirm rail cant variation or design exceptions.

The rail cant measurement tool according the present specifications is designed to provide accurate measurement of existing rail cant, as summarized in more detail hereinafter.

SUMMARY OF THE INVENTION

The present invention relates generally to measurement tools for use in the rail industry. More particularly, the present invention relates to measurement tools for measuring the cant of rail, or rail cant measurement tools.

To this end, in an embodiment of the present invention, a rail cant measurement tool is provided. The rail cant measurement tool comprises a rail centerline reference head for rigidly placing on a first rail of a pair of parallel rails for determining a vertical rail centerline of the rail, and a track plane reference bar, and a measurement gauge having a measuring mechanism rotatably connected to the track plane reference bar for measuring rail cant.

As noted hereinabove, rail cant is defined as the angle made between the vertical rail centerline with trackplane as defined by a straight edge laid across the track. Since tie-plates are typically 1:40 angle or 1.43 degrees, the normal cant of each rail will be 1.43 degrees toward the center of the track.

Positive cant is defined as cant angle toward the center of the track from vertical. Vertical cant is defined as zero degree cant (absolute). Negative cant is defined as cant angle toward the field side of the track from vertical (absolute). Relative cant is defined as any deviation from normal cant. Normal relative cant is zero degrees. Normal absolute cant is 1.43 degrees. Negative cant is cant angle toward the field whether absolute or relative. Positive cant is cant angle toward the center of the track whether absolute or relative.

It is desirable to have a hand tool that can easily and accurately measure rail cant since this measurement has become important in track maintenance activities for the prevention of expensive and dangerous derailments. The value in preventing derailments is measured in lives lost or people injured and property damage in the millions of dollars. Railroads are typically self-insured for the first million or two and even minor derailments can easily cost that much.

The rail cant measurement tool, according to the present invention, essentially comprises a track plane reference bar optionally outfitted with certain track cross-level indicator means, and at least one cant angle measurement assembly.

In an embodiment, each clamp cant angle measurement assembly preferably comprises certain fillet radius reference rollers, certain fillet radius reference roller links, certain pivot arms, web clamp actuation bars, a web clamp lock-release mechanism, rail cant indicating means, and certain linear slide bearing means.

To use the rail cant measurement tool according to this embodiment of the present invention, the user first identifies a target section of track or target track section. The rail cant measurement tool may then be aligned with the target track section and configured such that the cant angle measurement assembly is in an open configuration for accepting the rail head. The lock-release assembly must be in a clamped or actuated or compressed spring configuration so as to expand the arms and web rollers for receiving the rail head.

The uppermost portions or contact points of the rail head contacting the track reference bar or beam define a plane across the top of the rails, namely, the track reference plane. The track reference bar is seated or rested upon the opposed rails such that the contact points provide or establish the track reference plane.

Once the roller end of the cant angle measurement assembly receives the rail head, and the web rollers are positioned adjacent the rail web, the lock-release assembly can be released allowing the compression spring to expand under restorative forces to a more relaxed spring configuration thereby forcing the blocks and actuator bars in opposite directions. The arms accordingly pivot about pivot axes thereby narrowing the space between web-opposed web rollers, and closing the roller end of the cant angle measurement assembly upon the rail web.

When the cant angle measurement assembly is clamped upon one section of rail, the compression spring in combination with the symmetric actuator arms and web rollers maintain the entire clamped cant angle measurement assembly collinear with the rail vertical center line of the transverse rail cross section.

The head of the cant angle measurement assembly rotates relative to the track reference bar through the action of a rotational bearing mounted on shaft that extrudes through the track reference bar. Linear slide bearings allow the clamp head to move bi-directionally relative to the rail vertical center line for use on differing rail gauges.

The web rollers may preferably engage upper and lower fillet radii respectively situated intermediate the rail web and the rail head, and the rail web and the rail foot. In this regard, it is contemplated that the series of web rollers may preferably have certain roller radii. The roller radii and fillet radii are substantially equal in magnitude such that when the rollers engage the upper fillets and lower fillets, the substantially equal roller and fillet radii and function to enhance device attachment to the rail.

While the track reference bar maintains contact with the uppermost contact points of the opposed rails, the device-to-rail seat assembly will align itself with the vertical center line of the rail section on which the cant angle measurement assembly is clamped. The rotary encoder measures the angle of the running surface plane relative the track reference plane for measuring and outputting rail cant information.

In other words, the cant angle is preferably measured by the rotary encoder as the angle between the straight edge of the track plane reference bar and the line perpendicular to the rail vertical center line. Rail cant may be indicated directly or relative to the track cross-level. Notably, if the rail cant is indicated relative to the track cross-level, a calculation must be made to determine cant for each rail.

To remove the device, the lock-release assembly is engaged and actuated so as to compress the compression spring, spread the clamp arms, and displace the web rollers away from one another so as to enable removal of the roller end of the cant angle measurement assembly from the target track section. A handle structure may be attached to the track reference arm for ease of installation and removal of the rail cant measurement tool at a select target track section.

In an alternate embodiment of the present invention, a rail cant measurement tool comprises a rail cant angle measurement assembly that may be slid or placed over a first rail, and slots, notches or apertures in the assembly may engage the base of the first rail. A track plane reference bar extends from the assembly, the distal end thereof placed on the top surface of a second rail. The track plane reference bar rotates relative to the assembly allowing rail cant to be measured on a rotating scale, measured as either positive or negative, and measured or read on both the relative and absolute scales.

The rail cant measurement tools according to the present invention thus enable rail maintenance crews to quickly and easily ascertain rail cant information at any given target track section. The rail cant measurement tools, however, in addition to providing new and useful structural improvements to this particular field of art, are believed to further support certain inherent methodology. In other words, certain methodology inherently supported the rail cant measurement tools of the present invention is further contemplated to fall within the ambit of the following disclosure.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIG. 16(*a*) is an enlarged, fragmentary section of the diagrammatic depiction otherwise presented in FIG. 16 presented to more clearly depict correspondingly similar web roller and fillet radii.

DETAILED DESCRIPTION OF THE PRESENTLY PREFERRED EMBODIMENTS

The present invention relates generally to measurement tools for use in the rail industry. More particularly, the present invention relates to measurement tools for measuring the cant of rail, or rail cant measurement tools.

As described herein, the rail cant measurement tools allow for a measurement of rail cant by measuring a track plane angle against a rail centerline angle. In that regard, the embodiments contained herein provide simple mechanisms for determining a rail centerline of a first rail, and a track plane angle between the first rail and a second rail in a pair of parallel rails, measured on a scale providing visual determination thereof. It should be noted that various means of determining a rail centerline are provided herein and comparing against track plane between two rails in parallel.

Figure 1:
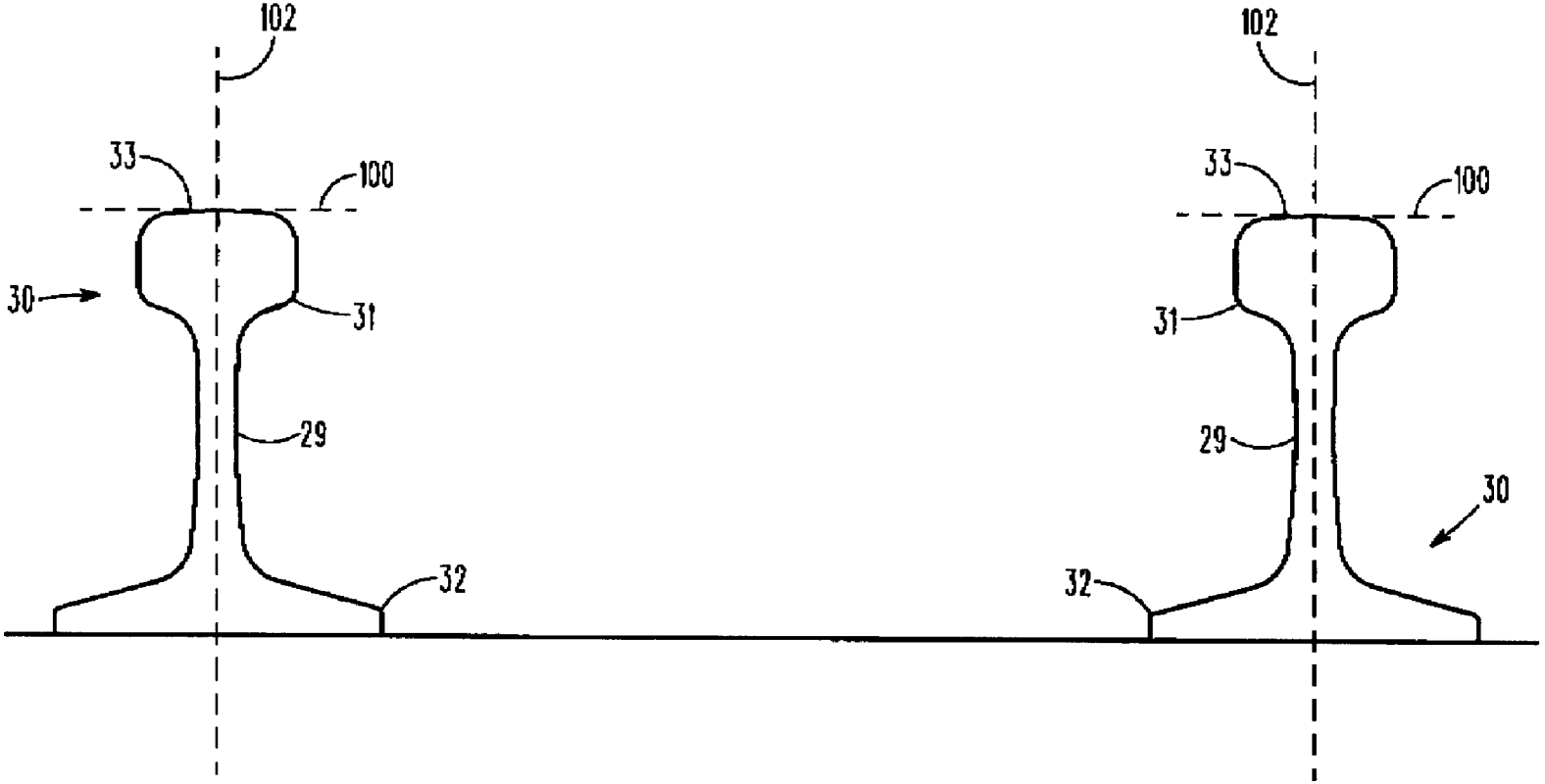
FIG. 1 is a first diagrammatic depiction of parallel, transverse rail sections depicted with zero degree or absolute rail cant depicting the rail vertical center lines and running surface planes of the rail sections.

Referring now to the drawings with more specificity, an embodiment of the present invention shown in FIG. 1 provides a rail cant measurement tool as at 10 for measuring rail cant. Rail cant may be defined as the angle 105 made between the running surface plane 100 (which plane 100 is ideally perpendicular to the vertical rail centerline 102) and the track reference plane as at 101 or the angle 105 between the vertical rail centerline 102 and the plane 103 perpendicular or normal to the track reference plane 101.

Figure 3:
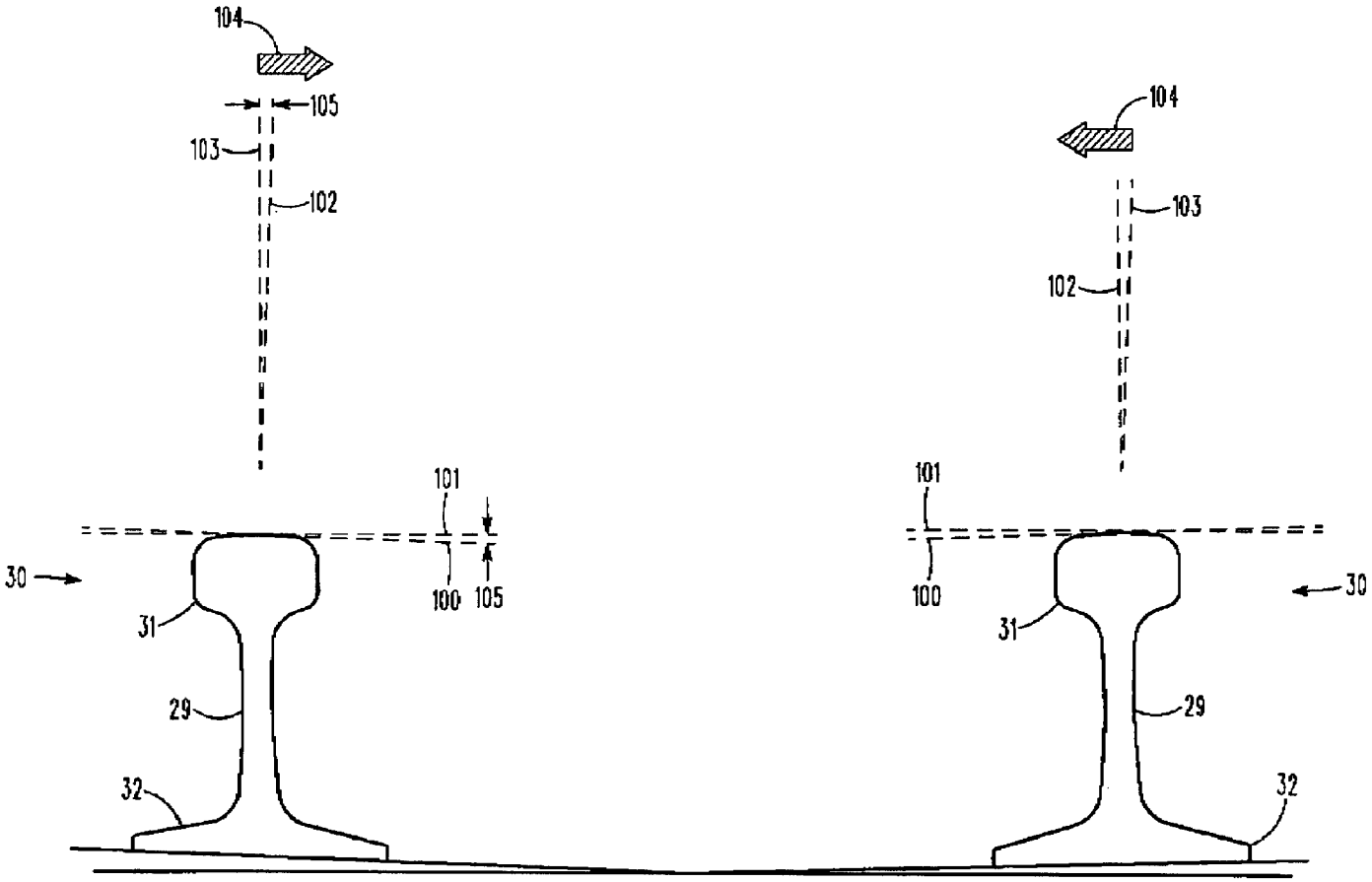
FIG. 3 is a diagrammatic depiction of parallel, transverse rail sections depicted with positive rail cant.

The track reference plane 101 may be most easily determined by providing a straight edge, and laying the same straight edge across a target track section. Since tie-plates are typically 1:40 angle or 1.43 degrees, the normal cant of each rail will be 1.43 degrees toward (as at vector 104) the center of the target track section. Positive cant is preferably defined as cant angle toward (as at vector 104) the center of the track from vertical as is generally depicted in FIG. 3.

Figure 2:
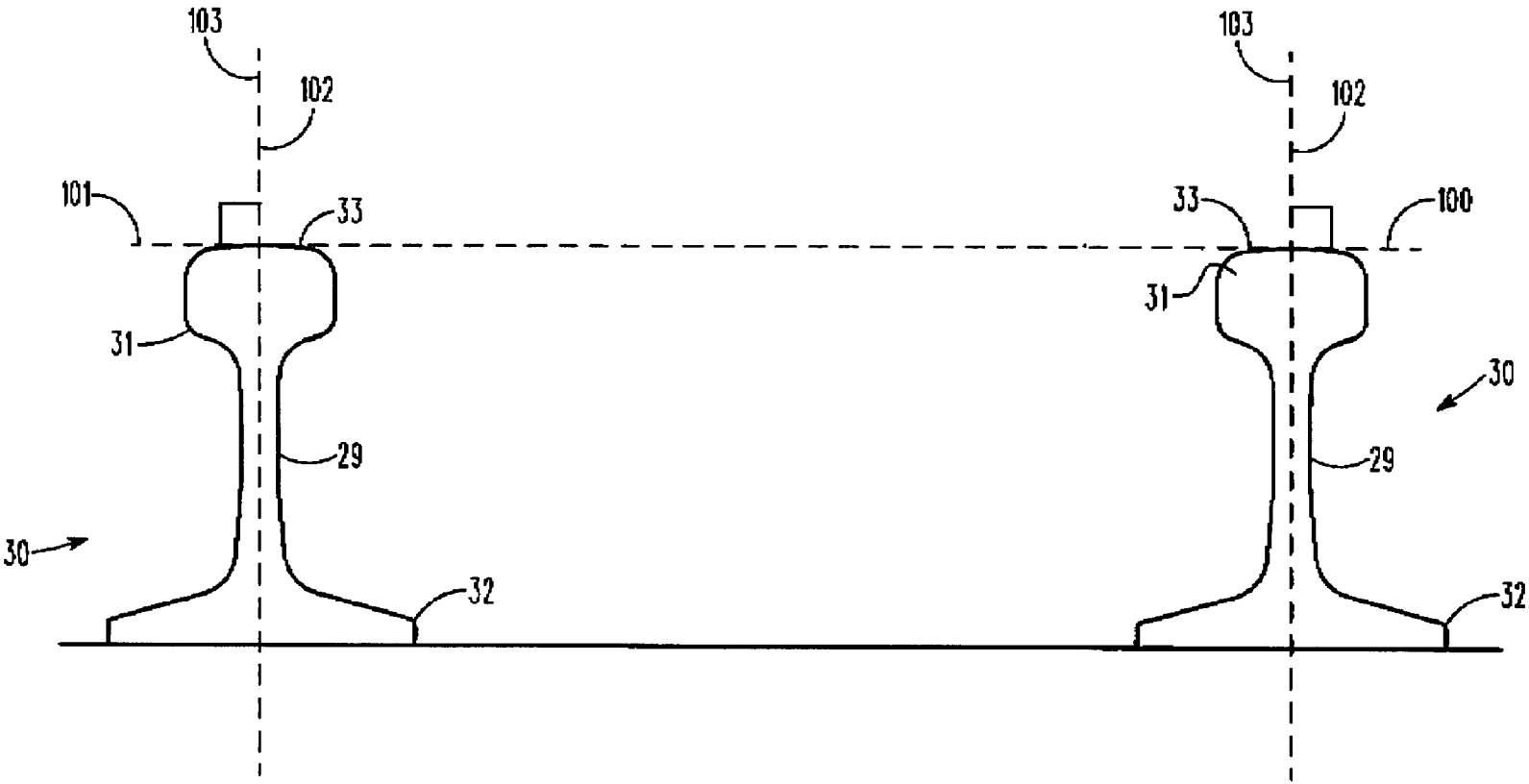
FIG. 2 is a second diagrammatic depiction of parallel, transverse rail sections depicted with zero degree or absolute rail cant depicting the rail vertical center lines and running surface planes of the rail sections, as well as a track reference plane coplanar with the running surface plans and planes orthogonal to the track reference plane and coplanar with the rail vertical center lines.
Figure 4:
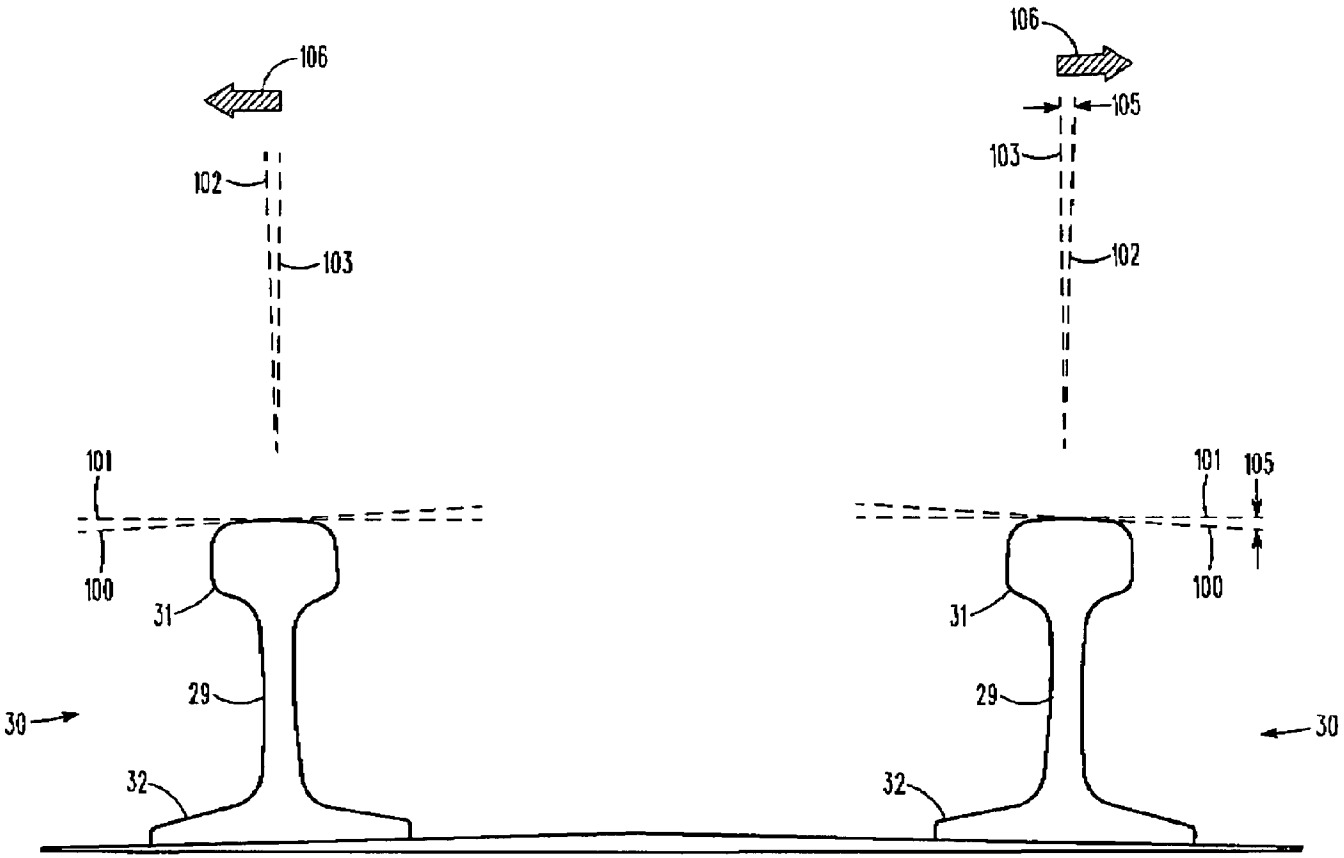
FIG. 4 is a diagrammatic depiction of parallel, transverse rail sections depicted with negative rail cant.

Vertical or absolute cant is preferably defined as zero degree cant as is generally depicted in FIGS. 1 and 2. Negative cant is preferably defined as cant angle toward (as at vector 106) the field side of the target track section from vertical as is generally depicted in FIG. 4. Relative cant is defined as any deviation from normal cant. Normal relative cant is zero degrees. Normal absolute cant is 1.43 degrees. Negative cant is cant angle toward the field whether absolute or relative. Positive cant is cant angle toward the center of the track whether absolute or relative.

As has been noted, it is highly desirable to provide a hand tool that can easily and accurately measure rail cant since this measurement has become important in track maintenance activities for the prevention of expensive and dangerous derailments. The value in preventing derailments is measured in lives lost or people injured and property damage in the millions of U.S. dollars. Railroads are typically self-insured for the first million or two and even minor derailments can easily cost that much.

Accordingly, to achieve the primary objective of providing a rail cant measurement tool, and other readily apparent objectives, the rail cant measurement tool 10 according to an embodiment of the present invention essentially comprises certain plane-determination means for determining the track reference plane 101, and certain cant-determination means for determining the cant angle 105 relative to the track reference plane 101. The plane-determination means may be exemplified by a track plane reference assembly, and the cant-determination means may be preferably exemplified by a cant angle measurement device or mechanism according to the embodiments of the present invention.

The track plane reference assembly according to an embodiment of the present invention preferably comprises a track plane reference bar or beam as at 11, which track plane reference bar or beam 11 may be preferably outfitted with certain track cross-level indicator means as at 12. As may be seen from an inspection of FIGS. 5 and 6, the track plane reference bar 11 essentially provides a straight edge as at 40 for defining a track reference plane 101.

The track reference plane may thus be determined from the straight edge 40 placed atop the uppermost portions of opposed rail heads 31 however inclined from vertical the vertical center line 102 may be. The straight edge 40 may thus rest atop the running surface 33 or upper edging of the rail head 31 adjacent the running surface 33 depending on the degree of rail cant 105.

As stated, the track plane reference bar or member 11, in combination with the track cross-level indicating means 12, together may be viewed as a preferred track plane reference assembly according to the present invention. It is contemplated that the track cross-level indicating means 12 according to the present invention may be exemplified by indicators of either mechanical or electrical design.

Conceivably, gravity operated linkages can operate mechanical indicators with expanded scale for easy reading. Further, it is contemplated that micro-electromechanical system (MEMS) type inclinometers may be used with microcontrollers, microprocessors, PIC chips or any other suitable embedded processing device in order to calibrate and calculate track cross-level.

On tangent track, it is typical and correct that both rails 30 must have the same elevation. In other words, an imaginary line at right angles to the two rails 30 connecting their tops must be level or horizontal. Curved track, however, is typically and correctly banked; the outside first rail 30 being raised relative to the inside second rail 30. The condition of cross level where one of the two rails 30 is purposely raised is known as super-elevation. The track cross-level indicating means 12 essentially function to generally indicate the degree of super-elevation of the first rail 30 relative to the second rail 30.

The cant-determination means is exemplified by at least one cant angle measurement device or assembly 13 cooperably and structurally associated with the track reference bar 11. In this regard a shaft 14 of the cant angle measurement device 13 is extruded through the track reference bar 11 and rotary or rotational bearing(s) as at 15 is/are mounted on or to the shaft 14 for enabling rotation of the shaft 14 and track reference bar 11 relative to plates 43. The head of the operative cant angle measurement device or mechanism 13 is thus made rotational relative to the track reference bar 11 by way of the rotational bearing(s) 15 and shaft 14. The shaft 14 and bearing(s) 15 may thus exemplify certain means for movably coupling the cant angle measurement assembly 13 to the track plane reference bar 11.

Each cant angle measurement device 13 may be further said to preferably a web-engaging arm assembly or assemblies as at 34; the spring-biased lock-release assembly as at 35; certain rail cant information measuring/outputting means as exemplified by a rotary encoder mechanism as at 36; and certain linear slide bearing means as exemplified by a series of linear slide bearing assemblies as referenced at 37.

The web-engaging arm assembly 34 preferably comprises eight web reference rollers as at 16; two V-shaped web reference roller links as at 17; four pivot arms as at 18; and two web clamp actuation bars as at 19. The pivot arms 18 each comprise upper arm ends 20, and lower arm ends 21. The upper arm ends 20 are attached to the spring-biased lock-release assembly 35 via the actuation bars 19 at the anterior or front side 38 and attached directly to the lock-release assembly 35 at the posterior or rear side 39 of the device 13.

In this regard, the lock-release assembly 35 preferably comprises a compression spring as at 22, opposed force transmission blocks as at 41, and handle-based means as at 42 for selectively compressing and releasing the compression spring 22 for respectively opening (via spring compression) and closing (via spring release) the device 13. The arm-clamping or closing forces are directed into the arms 18 via the bars 19 and blocks 41, and forced action of the spring-biased lock-release assembly 35 when the lock-release assembly 35 is released and the compression spring 22 returns to a more relaxed spring state.

The V-shaped web reference roller links 17 each preferably comprise a vertex or pin end 23 and a roller end 24. The pin ends 23 are connected by way of a hinge pin as at 25, which hinge pins 25 each have a pin axis as at 107. The rollers 16 are attached to the roller ends 24 of the roller links 17, and have axes of rotation as at 108 parallel to the pin axes 107. The hinge pins 25 are each outfitted with torsion springs 26, which springs 26 cooperably interact with spring stop structures 27 and spring-receiving windows 28 formed in the vertex end or pin ends 24 of the roller links 17. It is contemplated that the torsion springs 26 enhance alignment of the rollers 16 and roller links 17 relative to the rail web 29 of a rail 30 for increasing the accuracy of output measured information indicative of rail cant angle 105.

The cant angle measurement device 13 essentially functions to clamp-engage a rail 30 of a target rail section. The rollers 16 engage the rail web 29 intermediate the rail head 31 and the rail foot 32 when the lock-release assembly 35 is released and the compression spring 22 returns under restorative forces to a more relaxed spring state.

Linear slide mounting plates 43 connected to the linear slide bearings 37 seat or rest upon the running surface 33 of the rail head 31 at the target track section and enable bi-directional (e.g. vertical) movement of the device-to-rail seat assembly (comprising the linear slide mounting plates 43, linear slide bearings 37, rotary encoder 36, and rotary encoder cover 44) along the vertical center line 102.

It should be noted that the coupled shaft 14 and arm 11 combination rotates relative to the linear slide mounting plates 43 so that the bottom straight edge 56 of the plates 43 seat or rest upon the (substantially planar) running surface 33 of the select rail head 31 while the bottom straight edge of the arm 11 rests upon the uppermost portion of the select rail head 31.

Recalling that the running surface 33 essentially defines the running surface plane 100, the track reference bar and cant angle measurement device or assembly 13 together essentially function to measure and output rail cant information reflective of the cant angle 105 intermediate the running surface plane 100 and the track reference plane 101 as defined by the bottom straight edge 40 of the track reference bar 11.

Figure 5:
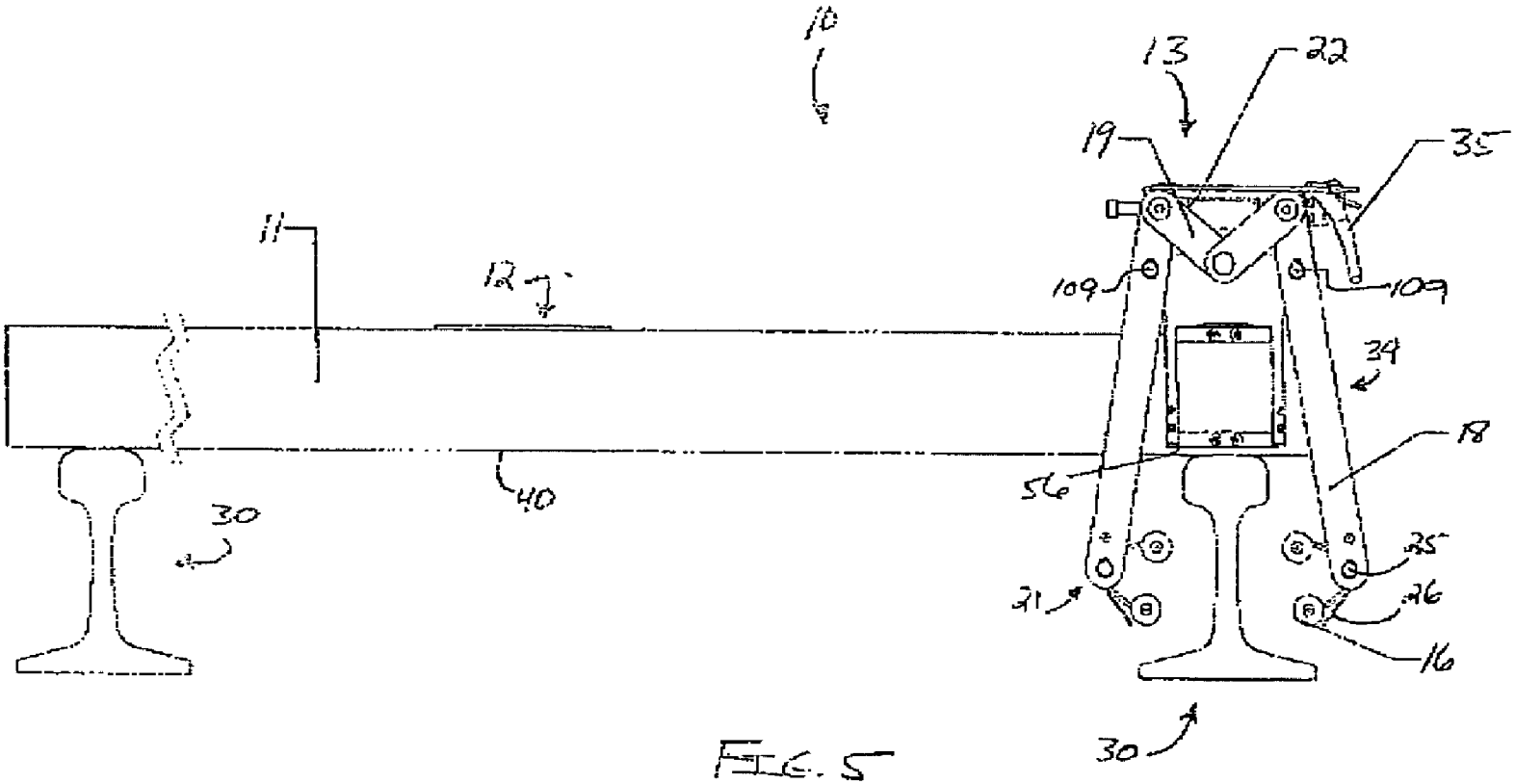
FIG. 5 is an anterior or frontal view of the rail cant measurement tool according to the present invention with the track plane reference assembly shown placed across parallel, transverse rail sections depicted with absolute cant with the cant angle measurement assembly in a rail-received open configuration prior to clamped engagement with the right most rail section.

To use the rail cant measurement tool 10, the user first identifies a target section of track or target track section. The rail cant measurement tool 10 may then be aligned with the target track section and configured such that the cant angle measurement assembly 13 is in an open configuration for accepting the rail head 31 as generally depicted in FIG. 5. The lock-release assembly 35 must be in a clamped or actuated or compressed spring configuration so as to expand the arms 18 and rollers 16 for receiving the rail head 31.

The uppermost portions or contact points of the rail head contacting the track reference bar or beam 11 define a plane across the top of the rails 30, namely, the track reference plane 101. The track reference bar 11 is seated or rested upon the opposed rails 30 such that the contact points provide or establish the track reference plane 101 as further generally depicted in FIGS. 5 and 6.

Once the roller end of the cant angle measurement assembly 13 receives the rail head 31, and the web rollers 16 are positioned adjacent the rail web 29, the lock-release assembly 35 can be released allowing the compression spring 22 to expand under restorative forces to a more relaxed spring configuration thereby forcing the blocks 41 and actuator bars 19 in opposite directions. The arms 18 accordingly pivot about axes 109 thereby narrowing the space between web-opposed web rollers 16, and closing the roller end of the cant angle measurement assembly 13 upon the rail web 29.

When the cant angle measurement assembly 13 is clamped upon one section of rail 30, the compression spring 22 in combination with the symmetric actuator arms 19 and web rollers 16 maintain the entire clamped cant angle measurement assembly 13 collinear (as at box 110) with the rail vertical center line 102 of the transverse rail cross section.

The head (as at box 110) of the cant angle measurement assembly 13 rotates relative to the track reference bar 11 through the action of a rotational bearing as at 15 mounted on shaft 14 that extrudes through the track reference bar 11. Linear slide bearings 37 allow the clamp head to move bi-directionally relative to the rail vertical center line 102 for use on differing rail gauges as generally and comparatively depicted in FIGS. 13-15.

Figures 13, 14, 15:
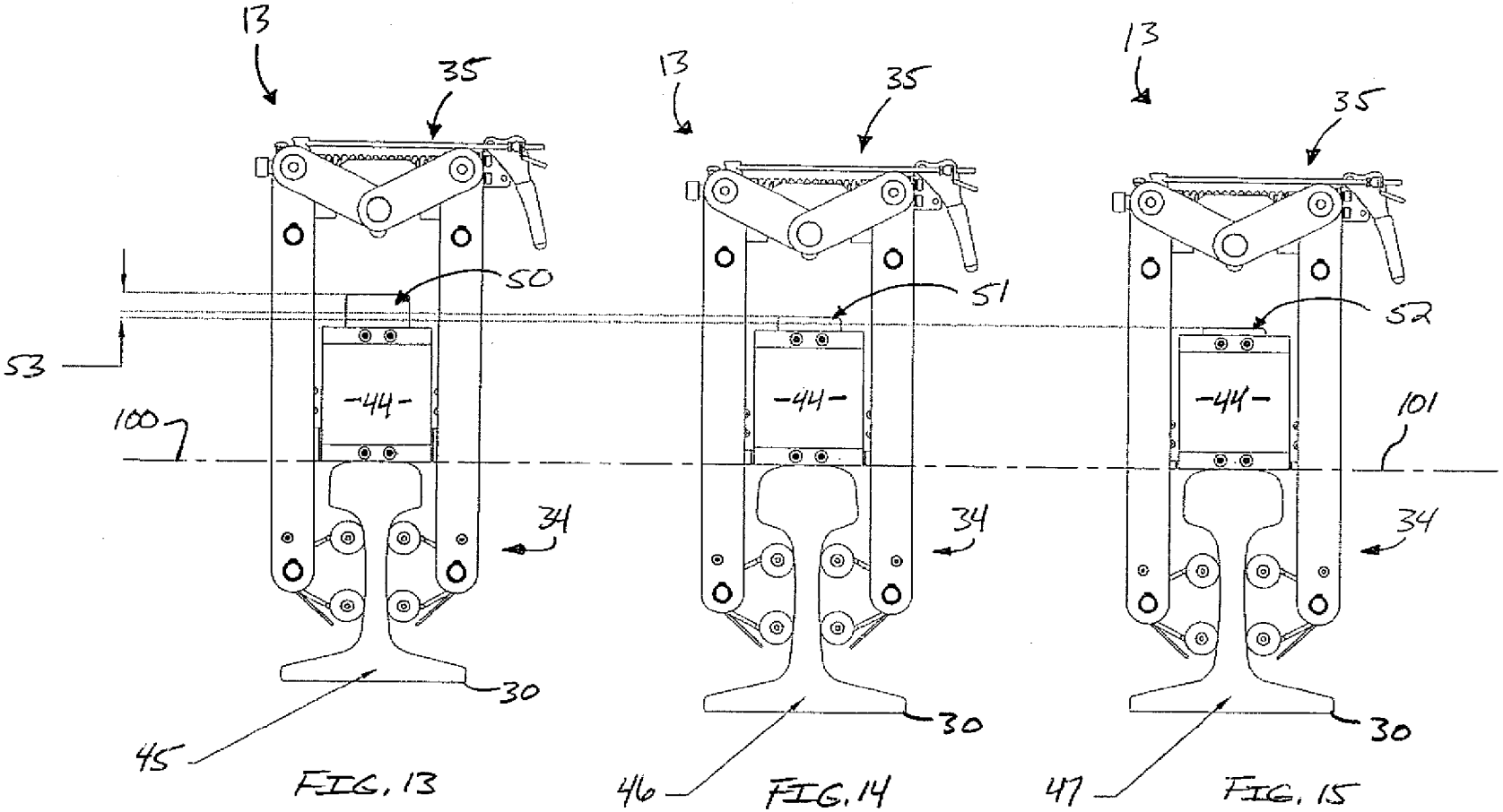
FIG. 13 is a first anterior or frontal view of the cant angle measurement assembly according to the present invention shown in a rail-received clamped configuration with a first rail having a first rail gauge in engagement therewith, the linear slide bearing means of the cant angle measurement assembly enabling or providing a comparative maximum downward displacement of the rotary encoder assembly.
FIG. 14 is a second anterior or frontal view of the cant angle measurement assembly according to the present invention shown in a rail-received clamped configuration with a second rail having a second rail gauge in engagement therewith, the linear slide bearing means of the cant angle measurement assembly enabling or providing a comparatively medium downward displacement of the rotary encoder assembly as compared to the downward displacements depicted in FIGS. 13 and 15.
FIG. 15 is a third anterior or frontal view of the cant angle measurement assembly according to the present invention shown in a rail-received clamped configuration with a third rail having a third rail gauge in engagement therewith, the linear slide bearing means of the cant angle measurement assembly enabling or providing a comparative minimum downward displacement of the rotary encoder assembly.

FIG. 13, for example, depicts the cant angle measurement assembly 13 clamped or outfitted upon 115 pound rail as at 45 showing a maximum vertical gap 50 (or maximum downward vertical displacement) enabled by way of the linear slide bearings 37. FIG. 14 comparatively depicts the cant angle measurement assembly 13 clamped or outfitted upon 141 pound rail as at 46 showing a medium vertical gap 51.

Finally, FIG. 15 depicts the cant angle measurement assembly 13 clamped or outfitted upon 136 pound rail as at 47 showing a minimum vertical gap 52 (or minimum downward vertical displacement). Exemplary degrees of the linear slide motion for the three illustrated and differing rail types are generally illustrated and comparatively depicted at 53.

The web rollers 16 may preferably engage upper and lower fillet radii as at 111 respectively situated intermediate the rail web 29 and the rail head 31, and the rail web 29 and the rail foot 32. In this regard, it is contemplated that the series of web rollers 16 may have certain roller radii as at 112.

Figures 16, 16A:
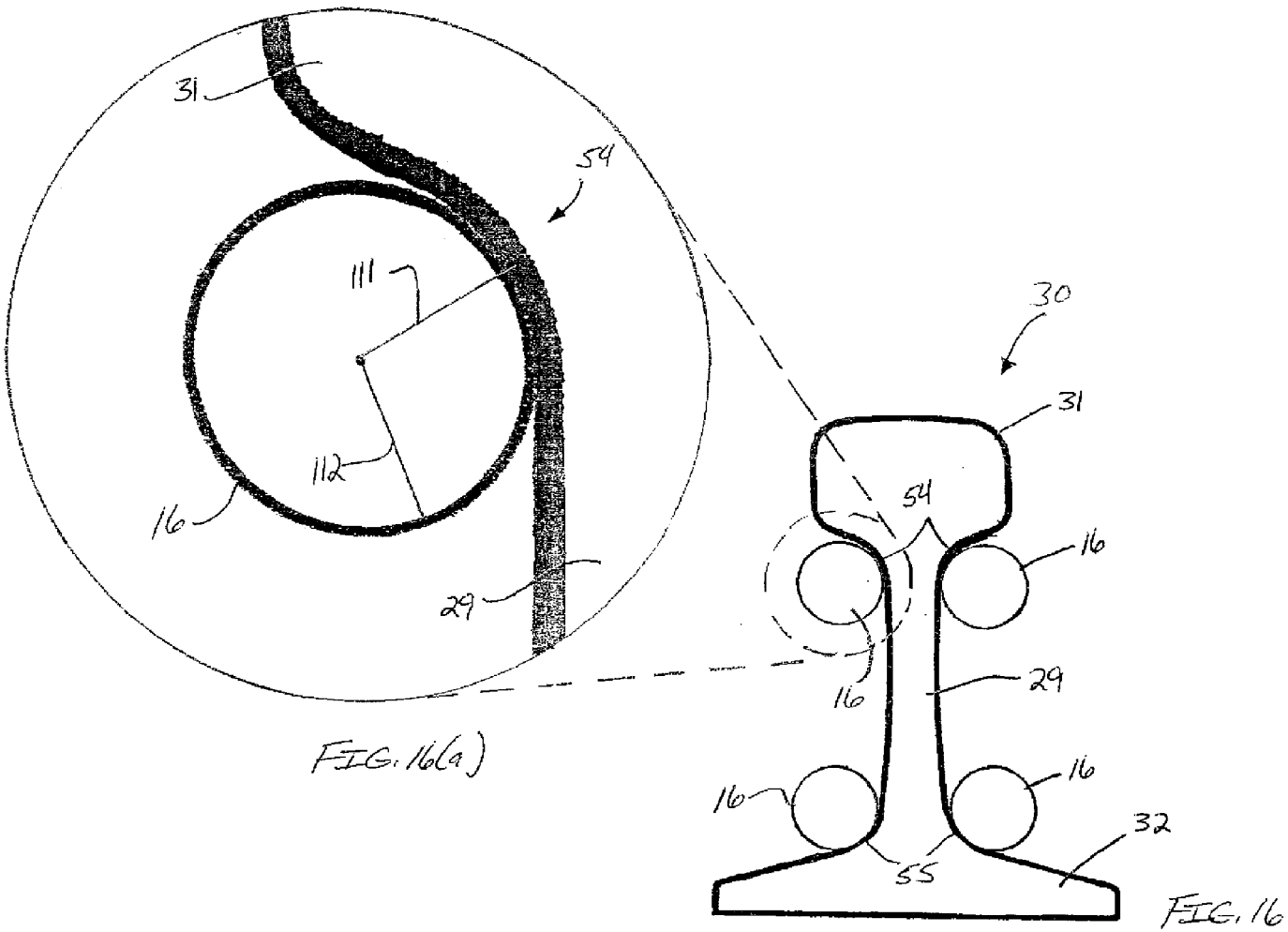
FIG. 16 is a diagrammatic depiction of a transverse section of rail shown outfitted with unsupported rollers to demonstrate for the reader where the web rollers according to the present invention may preferably engage the web-head fillets and web-foot fillets of the rail.
Figure 19:
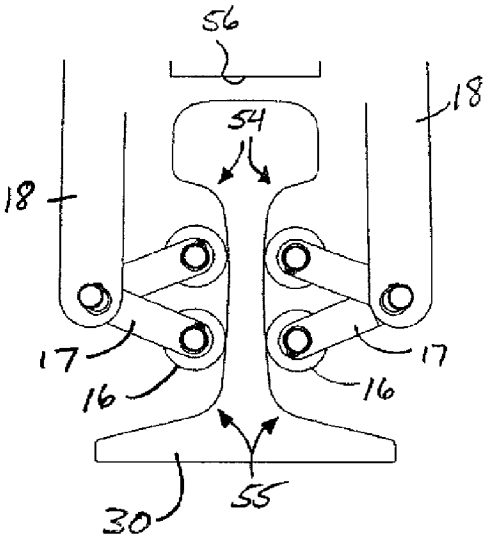
FIG. 19 is a third anterior or frontal fragmentary view of the cant angle measurement assembly according to the present invention shown in a rail-received clamped configuration with a third rail wherein the web rollers are alternatively engaged with second portions of the rail web for enhancing assembly-to-web engagement and accuracy of rail cant measurements.
Figure 18:
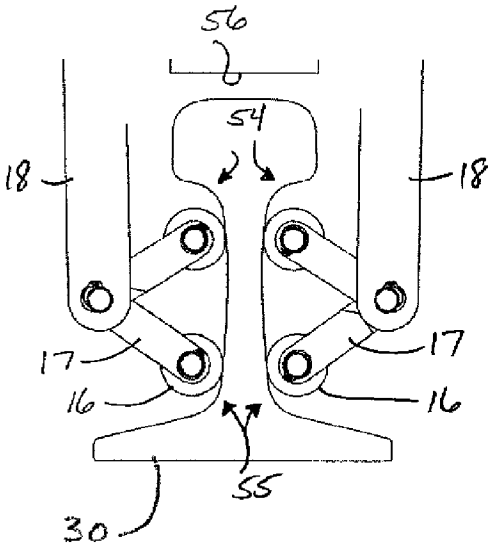
FIG. 18 is a second anterior or frontal fragmentary view of the cant angle measurement assembly according to the present invention shown in a rail-received clamped configuration with a second rail wherein the web rollers are alternatively engaged with first portions of the rail web for enhancing assembly-to-web engagement and accuracy of rail cant measurements.
Figure 17:
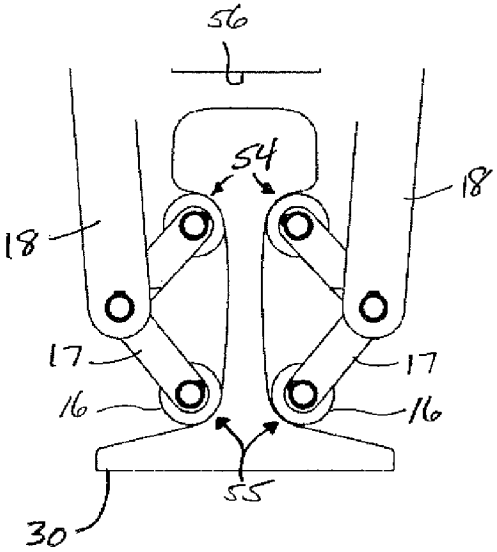
FIG. 17 is a first anterior or frontal fragmentary view of the cant angle measurement assembly according to the present invention shown in a rail-received clamped configuration with a first rail wherein the web rollers are preferably engaged with head-to-web fillets and foot-to-web fillets for enhancing assembly-to-web engagement and accuracy of rail cant measurements.

From an inspection of FIG. 16(*a*), for example, it will be seen that the roller radii 112 and fillet radii 111 are substantially equal in magnitude such that when the rollers 16 engage the upper fillets 54 and lower fillets 55, the substantially equal roller and fillet radii 112 and 111 function to enhance device attachment to the rail 30.

Figure 6:
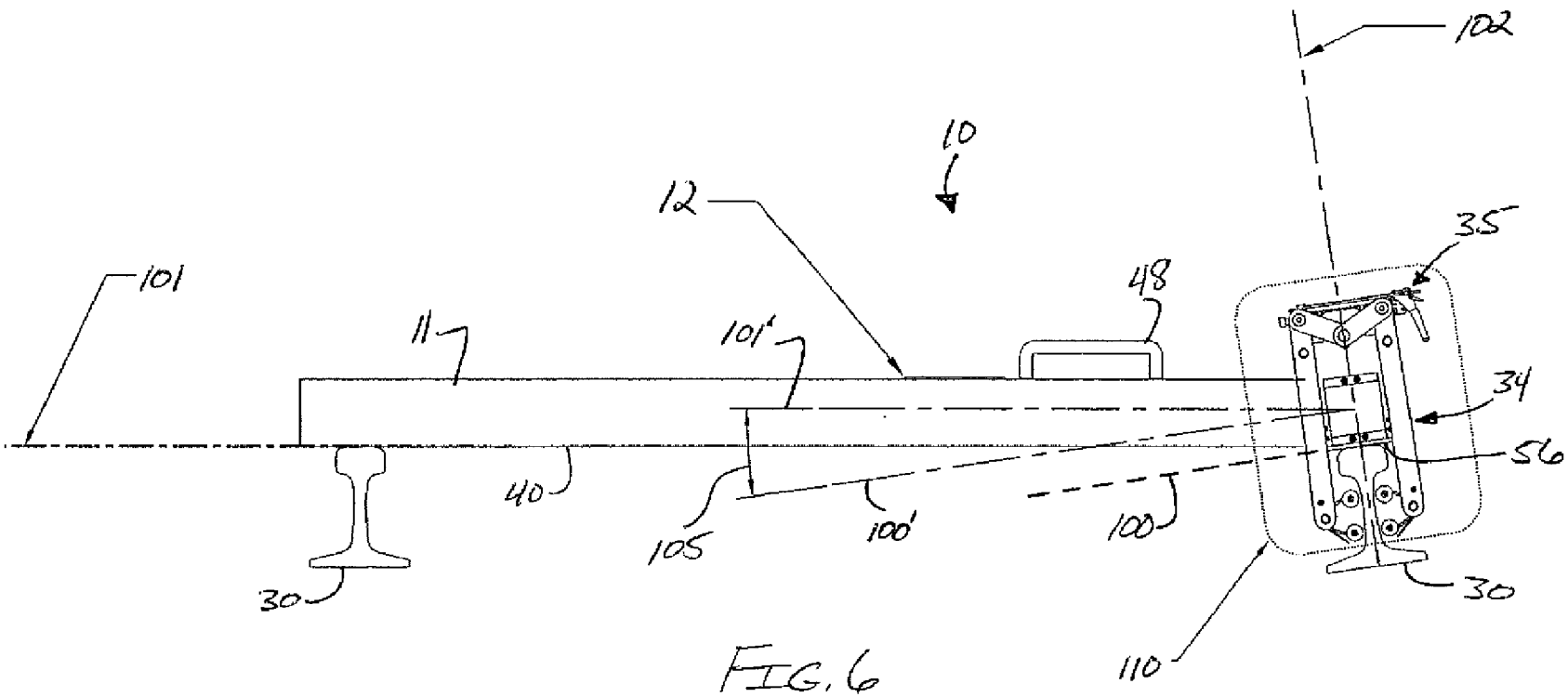
FIG. 6 is an anterior or frontal view of the rail cant measurement tool according to the present invention with the track plane reference assembly shown placed across parallel, transverse rail sections depicted with varied rail cant with the cant angle measurement assembly in a rail-received closed configuration after clamped engagement with the right most rail section.
Figure 7:
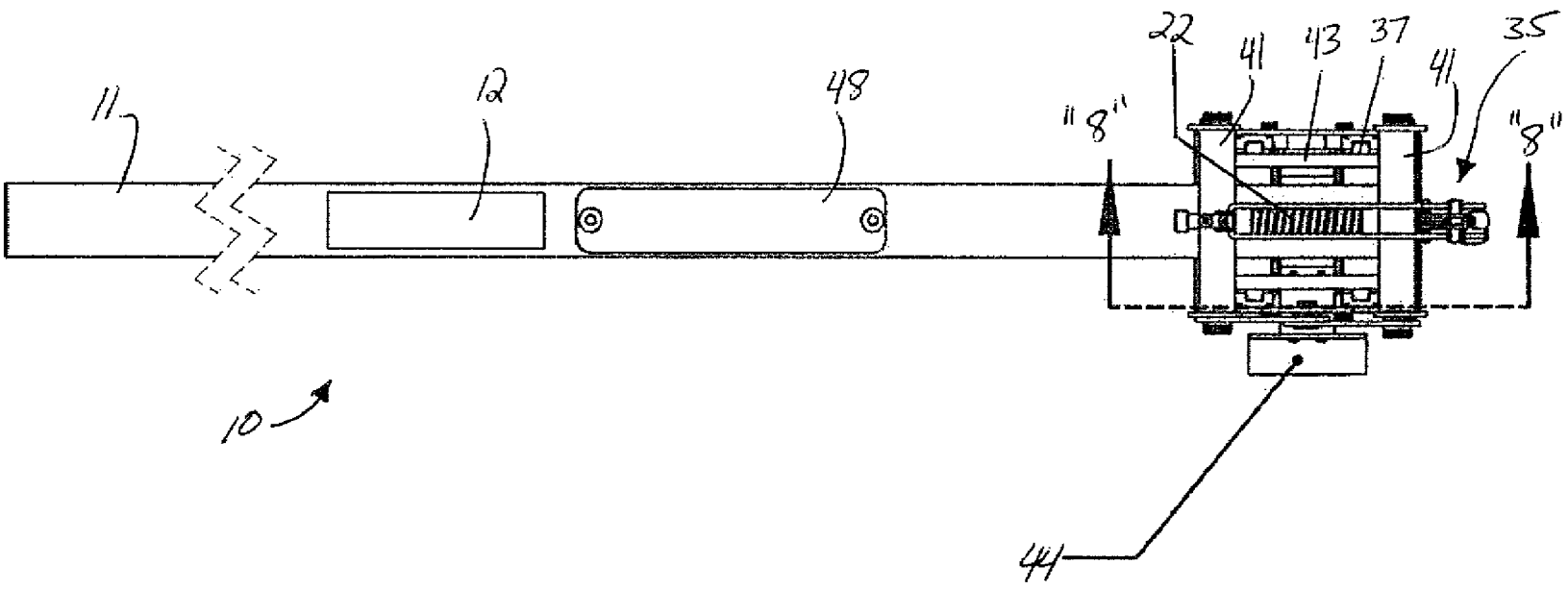
FIG. 7 is a top plan type view of the rail cant measurement tool according to the present invention showing the track reference bar of the track plane reference assembly with a break therein to depict an abbreviated track reference bar for ease of illustration and clarity.
Figure 8:
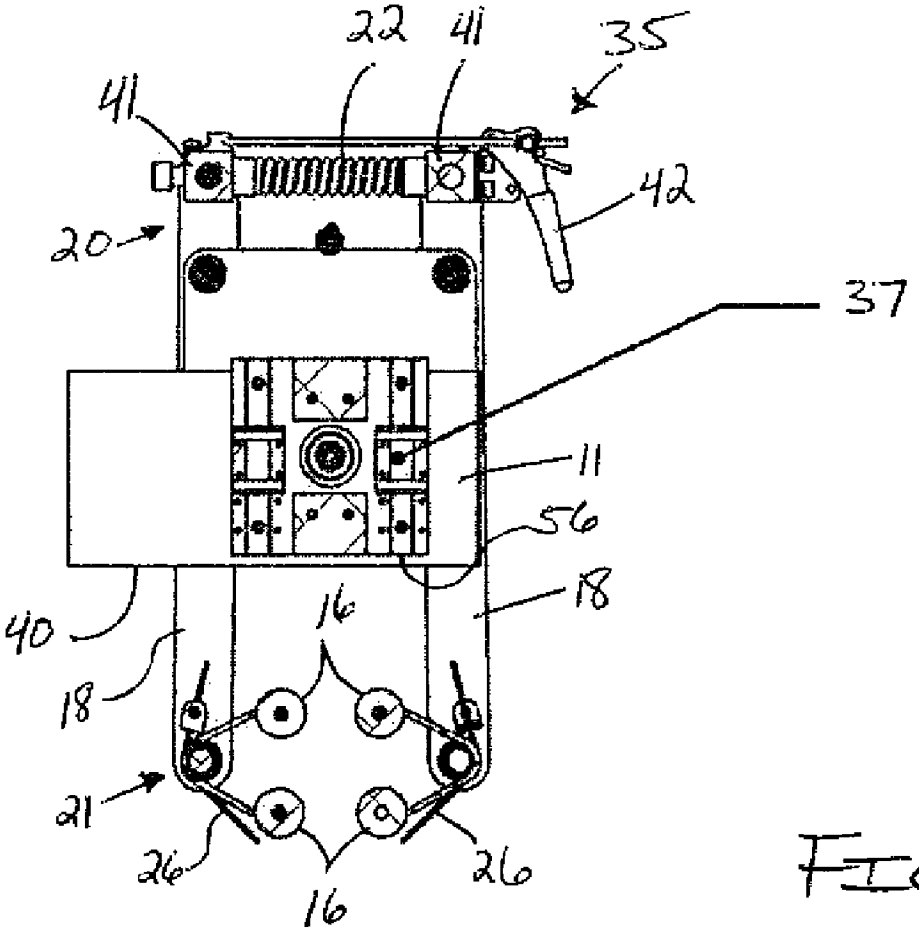
FIG. 8 is a fragmentary sectional view of the rail cant measurement tool according to the present invention as sectioned from FIG. 7 to primarily depict portions of the cant angle measurement assembly.
Figure 9:
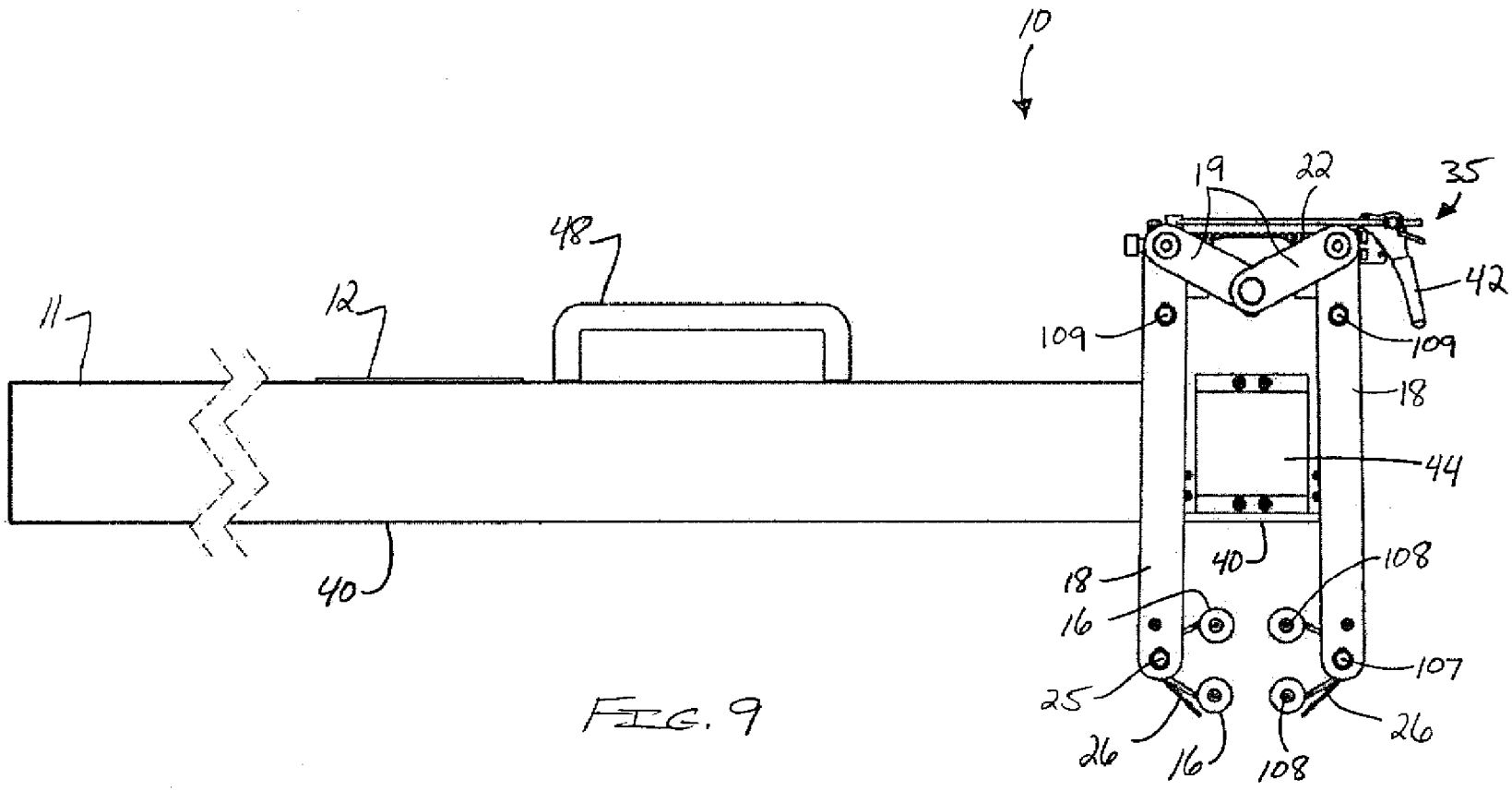
FIG. 9 is an anterior or frontal view of the rail cant measurement tool according to the present invention showing the track plane reference assembly and the cant angle measurement assembly in a closed configuration.
Figure 10:
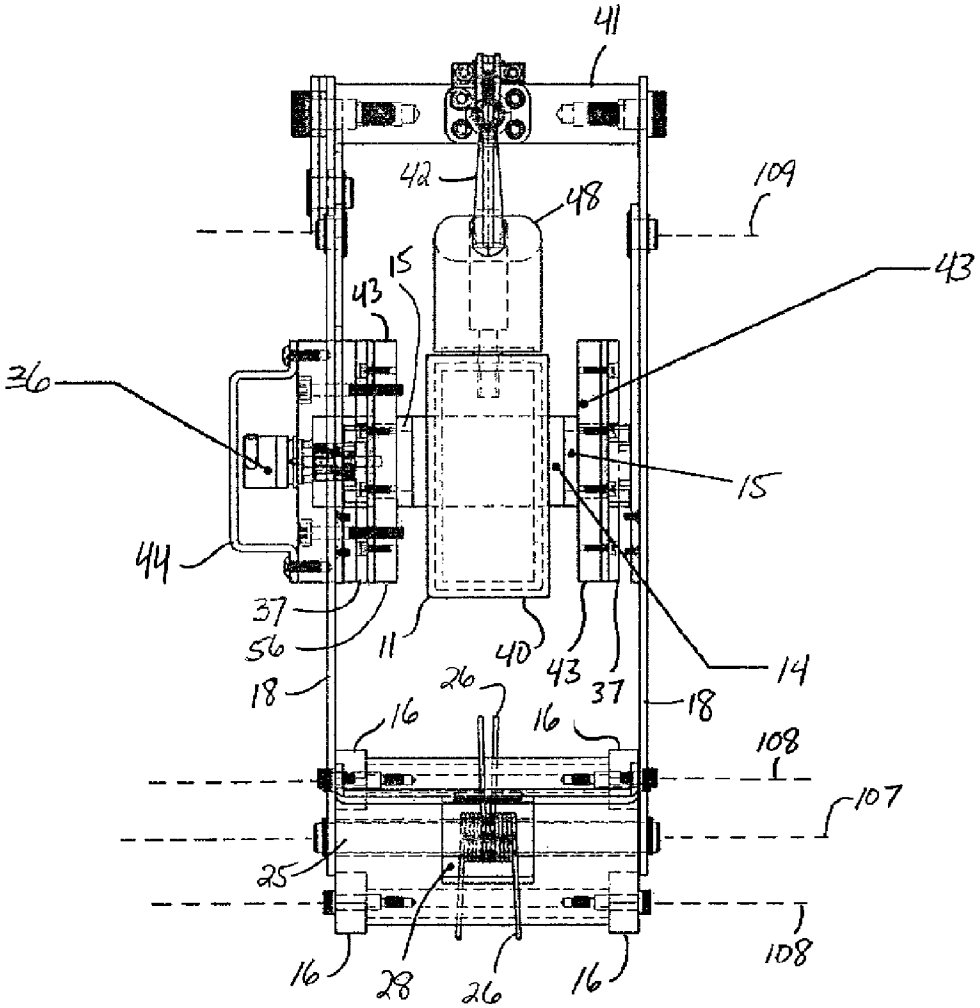
FIG. 10 is an end view of the rail cant measurement tool according to the present invention showing the track reference bar and the cant angle measurement assembly coupled by way of a bearing mounted shaft extruded through the track reference bar.
Figure 11:
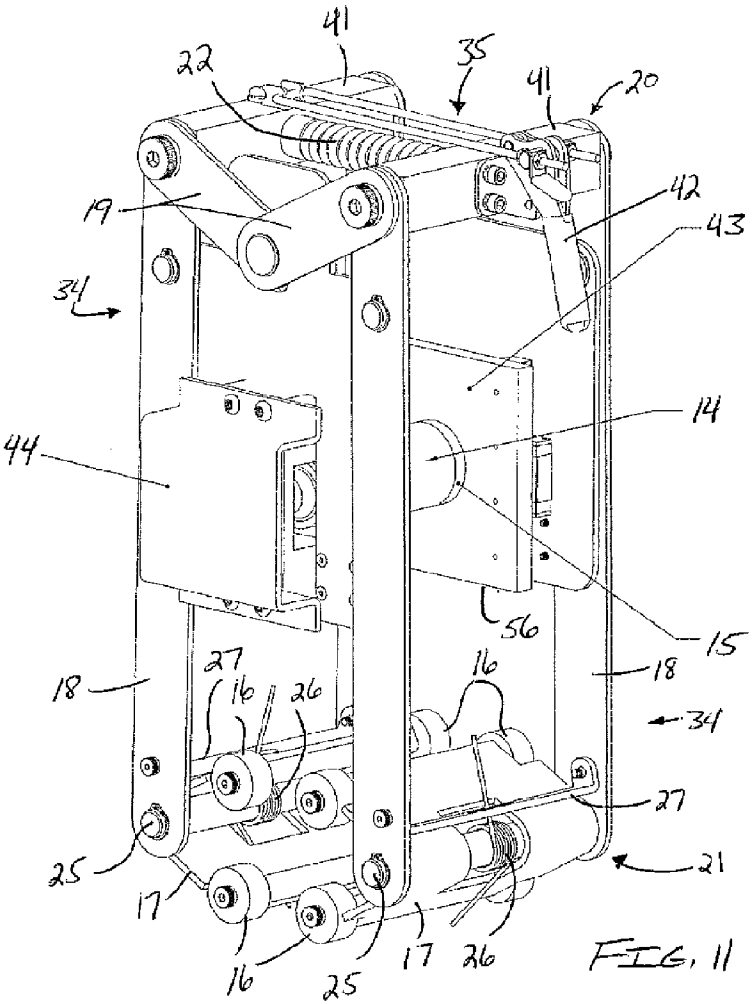
FIG. 11 is a top perspective view of the cant angle measurement assembly according to the present invention shown in an assembled closed configuration.
Figure 12:
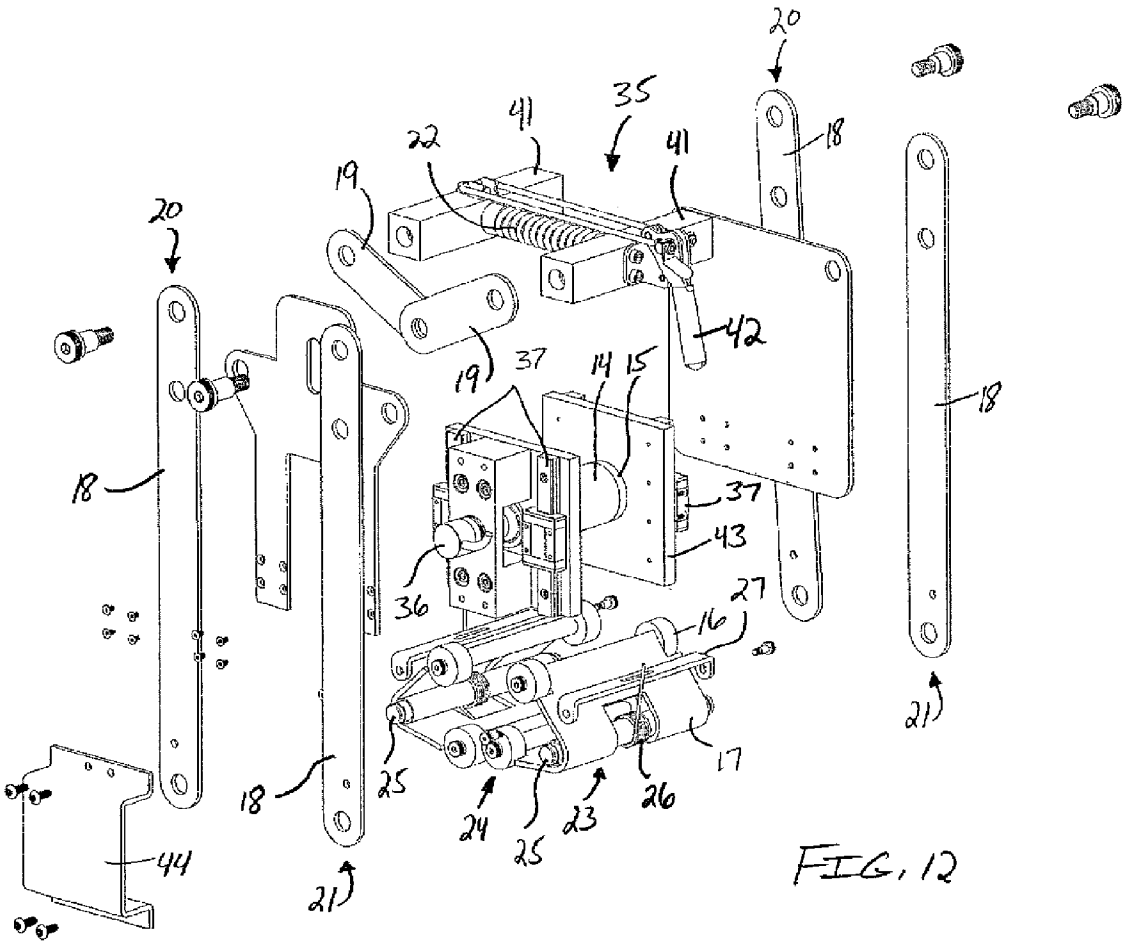
FIG. 12 is an exploded top perspective view of the cant angle measurement assembly according to the present invention, inclusive of numerous fasteners for assembling the cant angle measurement assembly.

While the track reference bar 11 maintains contact with the uppermost contact points of the opposed rails 30, the device-to-rail seat assembly will align itself with the vertical center line 102 of the rail section on which the cant angle measurement assembly 13 is clamped. The rotary encoder 36 measures the angle of the running surface plane 100 relative the track reference plane 101 for measuring and outputting rail cant information. FIG. 6 depicts the cant angle as measured from the site of the rotary encoder 36 showing plane 101' parallel to track reference plane 101 and plane 100' parallel to running surface plane 100.

In other words, the cant angle 105 is preferably measured by the rotary encoder 36 as the angle between the straight edge 40 of the track plane reference bar 11 and the line (or plane 100) perpendicular to the rail vertical center line 102. Rail cant may be indicated directly or relative to the track cross-level. Notably, if the rail cant is indicated relative to the track cross-level, a calculation must be made to determine cant for each rail.

To remove the device, the lock-release assembly 35 is engaged and actuated so as to compress the compression spring 22, spread the clamp arms 18, and displace the web rollers 16 away from one another so as to enable removal of the roller end of the cant angle measurement assembly 13 from the target track section. A handle structure as at 48 may be attached to the track reference arm 11 for ease of installation and removal of the rail cant measurement tool 10 at a select target track section.

The rail cant measurement tool 10 according to an embodiment of the present invention thus enables rail maintenance crews to quickly and easily ascertain rail cant information at any given target track section. The rail cant measurement tool 10, however, in addition to providing new and useful structural improvements to this particular field of art, is believed to further support certain inherent methodology. In other words, certain methodology inherently supported by the rail cant measurement tool is further contemplated to fall within the purview of the foregoing specifications.

For example, it is further contemplated that the present specifications support a method for measuring rail cant, which method comprises a series of steps, including the initial provision of a rail cant measurement tool, and the subsequent application of that tool 10 by engaging a select rail section of a select target track section via the cant angle measurement assembly 13 and track reference assembly of the rail cant measurement tool 10 according to the present invention.

When the rail cant measurement tool 10 is attached to the rail 30 or target rail section, the web rollers 16 thereby may engage upper and lower fillet radii (as at 111) respectively situated intermediate the rail web 29 and rail head 31, and the rail web 29 and rail foot 32. Once the rail cant measurement tool 10 is engaged with the target track section, certain track cross-level information can be read or ascertained via the cross level indicating means 12, and certain rail cant information can be read or ascertained via the rail cant indicating means or cant-determination means. The rail cant information may be optionally determined relative to the track cross-level information.

Stated another way, the present invention may be said to support a method for measuring rail cant, whereby a target track section is initially identified, which track section comprises opposed, parallel rail portions 30. Each rail portion 30 comprises a rail head 31, a rail foot 32, and a rail web 29 extending intermediate the rail head 31 and rail foot 32. The rail head to rail web junction site comprises an upper rail fillet as at 54, and the rail foot to rail web junction site comprises a lower rail fillet as at 55.

A device such as that exemplified by cant angle measurement assembly 13 may then be removably attached (or clamped) to a select rail portion 22, which cant angle measurement assembly 13 is pre-outfitted with certain rail cant indicating or cant-determination means, and which cant angle measurement assembly 13 is interconnected with a cross-member (as at 11), which cross-member 11 may be outfitted with certain cross-level indicating means (as at 12). Certain track cross-level information may then be read or ascertained via the cross-level indicator means; and certain rail cant information may then be read or ascertained via the rail cant indicating means.

It is contemplated that the indicators may be either mechanical or electrical in design. Conceivably, gravity operated linkages can operate mechanical indicators with expanded scale for easy reading. Further, it is contemplated that micro-electromechanical system (MEMS) type inclinometers may be used with microcontrollers, microprocessors, PIC chips or any other suitable embedded processing device in order to calibrate and calculate individual rail cant and other track measurement parameters such as track gauge.

While the foregoing specifications set forth much specificity, the same should not be construed as setting forth limits to the invention but rather as setting forth certain embodiments and features. For example, as prefaced hereinabove, it is contemplated that the present invention essentially provides a rail cant measurement tool. The rail cant measurement tool according to the present invention essentially functions to measure rail cant and is believed to essentially comprise certain plane-determination means (e.g. an object having a straight edge) cooperable with certain cant-determination means. The plane-determination means essentially function to determine a track reference plane of a track assembly, which track assembly comprises opposed rails, each of which comprise a rail head and a rail web.

The plane-determination means are engageable with the opposed rails at uppermost portions of the rail heads, each of which comprise a substantially planar running surface. The plane-determination means may preferably comprise a track plane reference assembly comprising a track plane reference bar the lower edge of which is a straight edge engageable with the opposed rails at the uppermost portions of the rail heads for defining the track reference plane.

The cant-determination means according to the present invention essentially function to determine rail cant relative to the track reference plane. The cant-determination means are engageable with the plane-determination means and a select planar running surface. The cant-determination means according to the present invention comprise certain means for measuring and outputting rail cant information reflecting the angle of the select planar running surface relative the track reference plane.

The cant-determination means according to an embodiment of the present invention may preferably comprise certain clamping means for selectively and removably positioning the cant-determination means into engagement with the plane-determination means and the select planar running surface. The clamping means may comprise a web-engaging (arm) assembly and certain assembly locking means as exemplified by the spring-biased lock-release assembly 35.

The web-engaging (arm) assembly essentially functions to position the cant-determination means into engagement with the plane-determination means and the select planar running surface via structural engagement with a select rail web. The web-engaging (arm) assembly preferably comprises opposed arm assemblies for engaging inner (track center side) and outer (field side) portions of the select rail web.

The opposed arm assemblies are preferably outfitted with certain roller means as exemplified by web rollers and the attendant hardware for enhancing assembly-to-web engagement of the opposed arm assemblies against the select rail web. The roller means according to the present invention preferably comprise certain spring means for enhancing alignment of the roller means during engagement with the select rail web so as to enhance the accuracy of the output measured rail cant information.

The assembly-locking means essentially function to selectively lock the web-engaging arm assembly in a web-engaging configuration, and may preferably comprise certain spring means for biasing the assembly-locking means in a head-receiving configuration as generally depicted in FIG. 5.

The cant-determination means may further preferably comprise a rotary encoder assembly and certain linear slide bearing means. The rotary encoder assembly according to the present invention is engageable with the select planar running surface for measuring and outputting the rail cant information. The linear slide bearing means essentially enable the cant-determination means to move orthogonally relative to the select planar running surface, thereby enabling tool use on varying rail gauges.

Essential methods for measuring rail cant are believed to comprise the basic steps of initially identifying a target track section comprising opposed, parallel rail portions, each rail portion comprising a rail head, a rail foot, and a rail web extending intermediate the rail head and rail foot. Certain plane-determination means may then be removably engaged with the opposed, parallel rail portions at the rail heads for determining a track reference plane of the target track section.

Certain cant-determination means are engaged or coupled with the plane-determination means and clamped upon a select rail head, which cant-determination means comprise certain information measurement and output means for measuring and outputting rail cant information as determined from the select rail head, which output measured rail cant information from the cant-determination means is received by the user.

The step of clamping the cant-determination means into engagement with the select rail head may preferably comprise the step of structurally engaging a select rail web with a web-engaging arm assembly, the web-engaging arm assembly for positioning the cant-determination means into engagement with the select rail head. The web-engaging arm assembly may preferably comprise opposed arm assemblies, however, which opposed arm assemblies engage both inner and outer portions of the select rail web when structurally engaging the same. The opposed arm assemblies may preferably be outfitted with certain roller means for enhancing assembly-to-web engagement of the opposed arm assemblies with the select rail web.

The step of engaging the select rail head via the cant-determination means may further preferably comprise the step of engaging a running surface of the select rail head with a rotary encoder assembly for measuring and outputting the rail cant information. Further, the step of engaging the running surface of the select rail head with the rotary encoder assembly comprises the step of engaging the select rail head with the rotary encoder assembly by way of certain linear slide bearing means for enabling a portion of the cant-determination means to move orthogonally relative to a portion of the plane-determination means.

Figure 20:
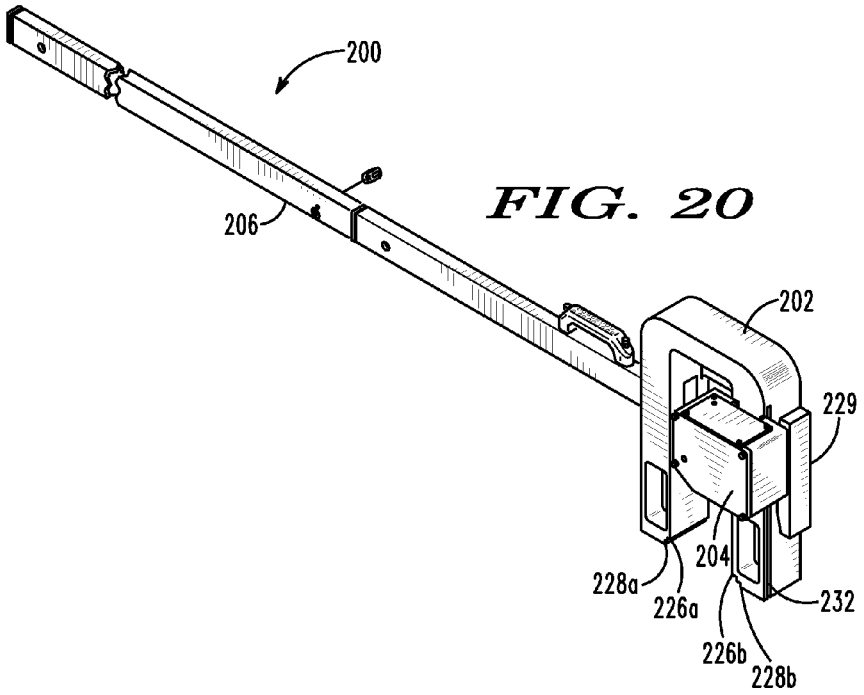
FIG. 20 illustrates a perspective view of a rail cant measurement tool in an alternate embodiment of the present invention.

FIG. 20 illustrates an alternate embodiment of a rail cant measurement tool 200 comprising, in general, a rail centerline reference head 202, a measurement gauge 204 and a track plane reference bar 206, each of which works in conjunction with the other components to allow a user to measure the rail cant of a rail in a pair of parallel rails utilized for railcars. The measurement gauge may be rotatably linked with the track plane reference bar.

The rail cant measurement generally operates by fixing the rail centerline reference head 202 onto a first rail of a pair of parallel rails (not shown in FIG. 20) and laying the track plane reference bar 206 from the first rail to the second parallel rail in the pair of parallel rails. The measurement gauge 204, affixed to the rail centerline reference head 202 may have an angle measuring apparatus that may be directly connected to the track plane reference bar 206. Because the measurement gauge 204 is affixed to the rail centerline reference head 202, the rotation of the track reference bar 206 in relation to the measurement gauge allows the measurement of rail cant by comparing the angle of the rail centerline to the angle of the track plane reference bar 206.

Figure 21:
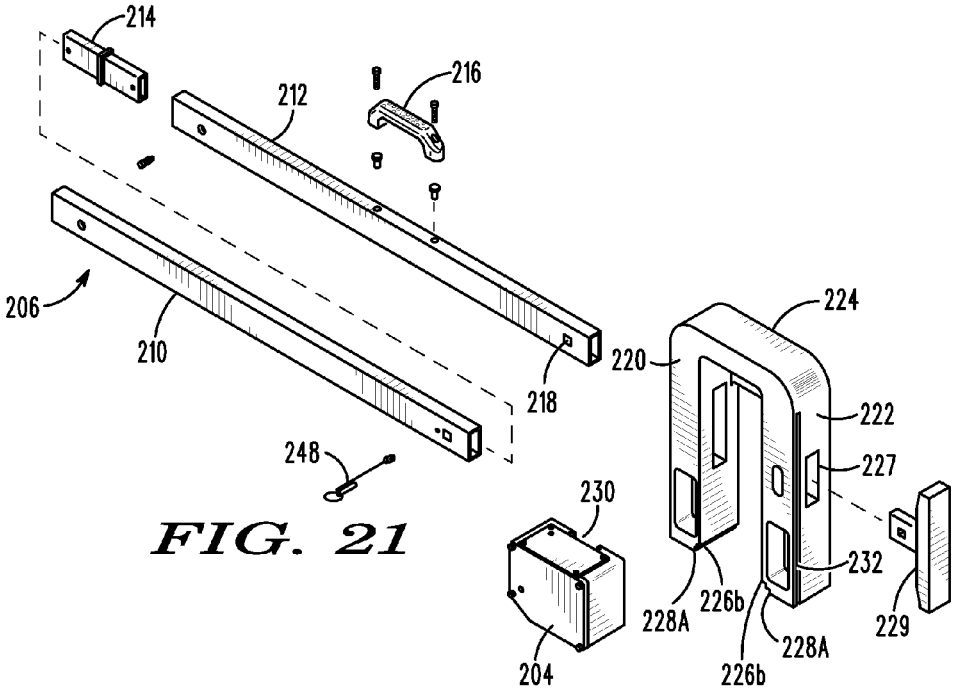
FIG. 21 illustrates an exploded perspective view of a rail cant measurement tool in an embodiment of the present invention.

FIG. 21 illustrates an exploded perspective view of the rail cant measurement tool 200 illustrating various parts therein. Specifically, the track plane reference bar 206 may comprise a plurality of parts, including but not limited to a first bar section 210, a second bar section 212 and, preferably, an insulator 214 that may link the first bar section 210 and the second bar section 212 to create the rigid, straight, track plane reference bar 206. The insulator 214 may aid in preventing shunting between the pair of parallel rails while measuring rail cant with the rail cant measurement tool 200. In a preferred embodiment, the first bar section 210 and the second bar section 212 may be made of a metal, or some other durable material. If made of electrically conductive metal, then the track plane reference bar 206 may preferably have the insulator to prevent shunting. However, it is also contemplated that shunting may be preventing by having the track plane reference bar 206 made from a non-conductive material, such as a plastic material or other like material. In addition, although the track reference bar 206 is described and illustrated as being made from the first bar section 210 and the second bar section 212, the track reference bar 206 may be made as a single piece, or from additional sections linked together to provide a straight, rigid reference for measuring rail cant.

A handle 216 may further be provided on the track plane reference 206 to aid a user in holding and carrying the same. Preferably, handle 216 is disposed at a center of gravity on the rail cant measurement tool to allow a user to easily hold and carry the same.

Figure 23:
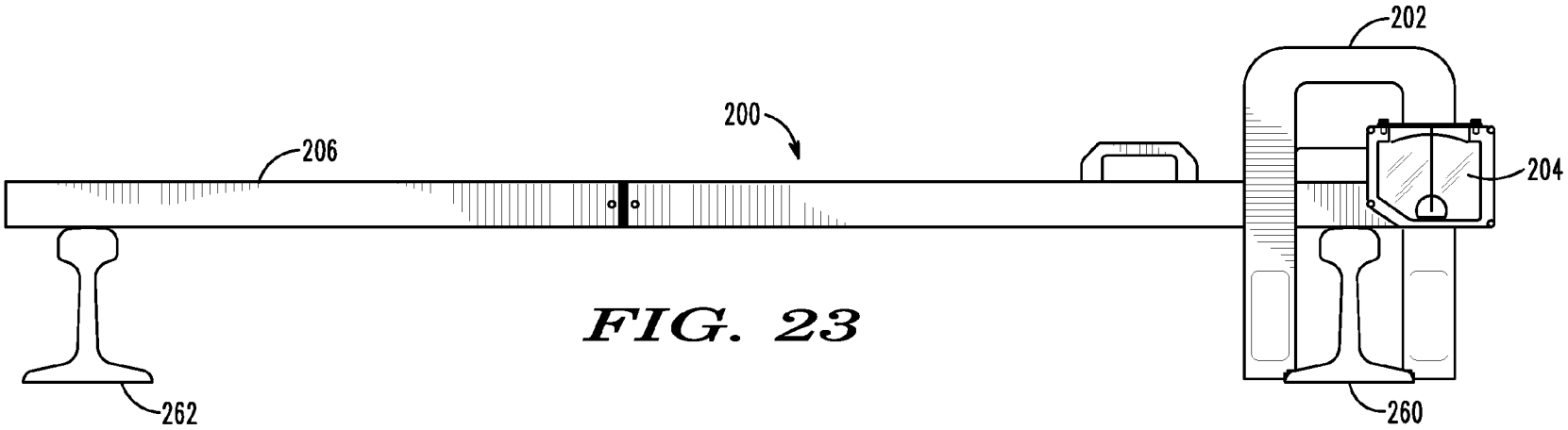
FIG. 23 illustrates an end view of a rail cant measurement tool fixed on a pair of parallel rails for measuring rail cant in an embodiment of the present invention.
Figure 24:
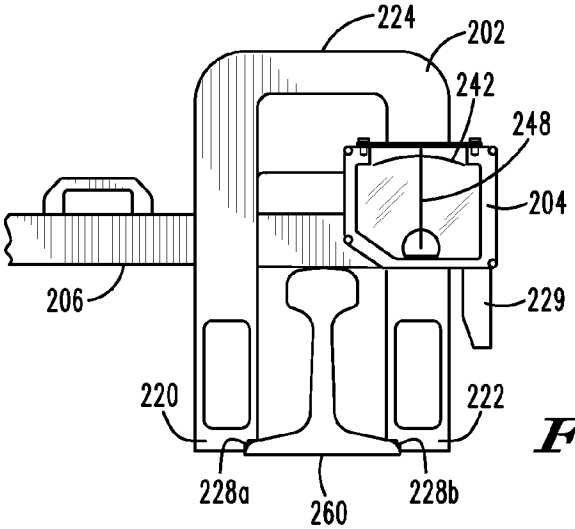
FIG. 24 illustrates a close-up end view of a rail cant measurement tool fixed on a rail for measuring rail cant in an embodiment of the present invention.

The rail centerline reference head 202 may generally be made from a strong, rigid material, such as a metal material or the like, and may be configured in a roughly upside down U-shape. Specifically, the rail centerline reference head 202 may have a first leg 220, a second leg 222 and a bridge portion 224. In use, the rail centerline reference head 202 may be disposed and fit over a rail, as illustrated in more detail in FIGS. 23 and 24. Specifically, it is generally known that rails may come in a variety of sizes, typically having a base measurement of 5¼ inches or 6 inches. As illustrated in FIGS. 20 and 21, each of the first and second legs 220, 222 may have receiving slots 226*a*, 226*b* (for a 5¼ inch rail base) and 228*a*, 228*b* (for a 6 inch rail base) for engaging the outside edges of the base of the rail, thereby allowing the rail centerline reference head 202 to be fixed on the rail when placed thereon, as illustrated in FIGS. 23 and 24.

A first slot 225 may be disposed within first leg 220 and a second slot 227 may be disposed within second leg 222 to allow the track plane reference bar 206 to pass therethrough, and engage the measurement gauge 204, as described in more detail below. An angle stop block 229 may be attached to a proximal end of the track plane reference bar 206 relative to the rail centerline reference head 202 to restrict the rotational movement of the track plane reference bar 206 to prevent articulation of the track plane reference bar 206 beyond the working limits of the measurement gauge 204.

The measurement gauge 204 may be fixed to the rail centerline reference head 202. As illustrated in FIG. 20, and as illustrated in the exploded view of FIG. 21, the measurement gauge 204 may comprise a keyed pocket 230 on a backside thereof that may engage second leg 222 by sliding within a receiving slot 232 on the second leg 222. Thus, the measurement gauge 204 may slide from a bottom end of the second leg 222 up the second leg 222 until in proper position. A pin 244 (not shown in FIG. 21) may extend from the back side of the measurement gauge 204 and link to the track plane reference bar 206 disposed within through first and second slots 225, 227 by passing through aperture 234 within second leg 222. The pin may be rigidly linked to track plane reference bar 206 so that rotatable movement of the track plane reference bar 206 on an axis formed by the pin may allow the pin to rotate within the measurement gauge 204 but relative to the rail centerline reference head 202, allowing measurement of the angle of rail cant, as described in more detail below with respect to FIG. 22.

Figure 22:
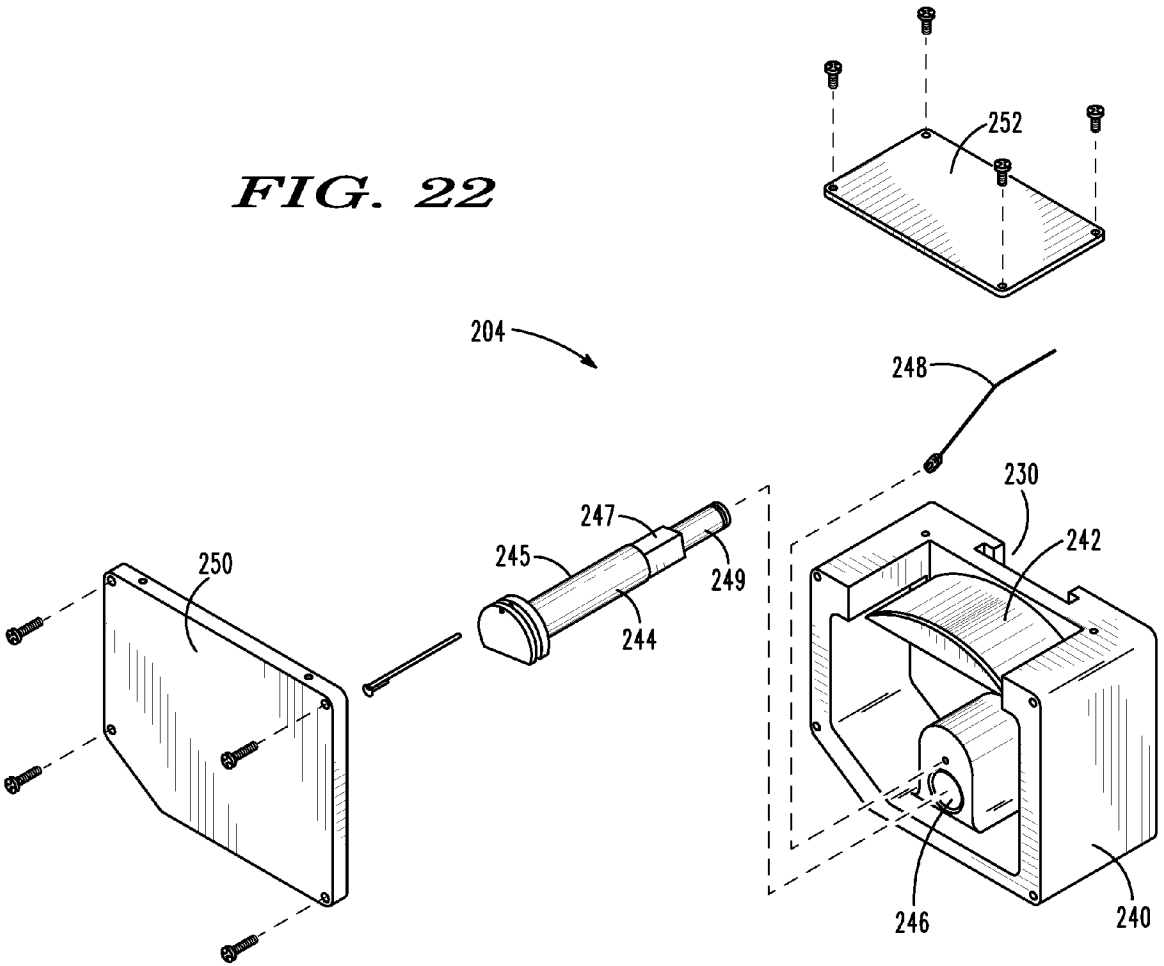
FIG. 22 illustrates an exploded perspective view of a rail cant measurement gauge in an embodiment of the present invention.

FIG. 22 illustrates an exploded view of measurement gauge 204 comprising a base 240 housing a scale 242 therein. Rotatable pin 244 may extend through aperture 246 within base 240 to link with the track plane reference bar 206, as described above. In a preferred embodiment, pin 244 may include an extending portion 245, a squared portion 247 and a locking portion 249. The extending portion 245 may extend through aperture 246, while squared portion 245 may extend through a matching squared aperture 218 in the track plane reference bar 206. The squared shape of the squared portion 247 and the matching squared aperture 218 ensure that the pin rotates with the track plane reference bar on the axis formed by the pin 244.

A needle 248 may further be rigidly attached to the rotating pin 244, the needle extending upwardly and over the scale 242, which may have rail cant measurement numbers thereon for reading the rail cant when the rail cant measurement tool is disposed on a rail, as described herein. Plates 250, 252 may be disposed over the base 240 to protect the internal movement of the pin 244 and needle 248. Moreover, the needle 248 may be configured to amplify the movement of the needle 248 against the scale. Preferably, plate 252 is transparent so as to be viewable therethrough so that the rail cant may be measured by viewing the needle 248 over the scale 242.

Although a particular measurement gauge is described herein, it should be noted that any means for visually displaying rail cant is contemplated by the present invention and the invention should not be limited as described herein. Specifically, although the present invention includes a simple scale and needle configuration, as described herein, the rail cant measurement may be provided digitally, or in any other manner apparent to one of ordinary skill in the art.

Rail cant measurement tool 200 may be utilized to measure rail cant of a first rail 260 of a pair of rails 260, 262, as illustrated in FIGS. 23 and 24. Specifically, rail centerline reference head 202 may be slid over the first rail 260, and slots or notches 228*a*, 228*b* (or 226*a*, 226*b* if the rail base width conforms thereto) may engage the base of the first rail 260, thereby allowing the rail centerline reference head 202 to proxy the rail centerline of the first rail 260. Track plane reference bar 206 may extend from the rail centerline reference head 202, the distal end thereof laying on the top surface of the second rail 262. Preferably, a user may place sufficient pressure on the rail centerline reference head 202 and the track plane reference bar 206 to ensure full contact with the first and second rails, respectively. In doing so, the track plane reference bar 206 may rotate relative to the rail centerline reference head 202 on an axis formed by pin 244 extending from measurement gauge 204, thereby allowing rail cant to be measured on scale 242, as described above. Thus, rail cant may be measured as positive or negative, and may be measured and read on both the relative and absolute scales.

As illustrated in FIGS. 20-24, rail centerline reference head 202 comprises slots or notches 226*a*, 226*b*, 228*a*, 228*b* disposed therein for engaging the base of a first rail, as described above. It should be noted that the rail centerline reference head 202 may comprise removable feet that may be utilized to engage the base of a first rail, wherein the removable feet may have slots or notches therein. The removable feet may attached and detached to the rail centerline reference head 202 as apparent to one of ordinary skill in the art, including for example a tongue and groove system. Thus, the feet having the slots or notches therein for engaging the base of the first rail may be attached or detached, allowing for different sizes of slots or notches depending on the size of the rail, or for replacing if damage occurs thereto.

Figure 25:
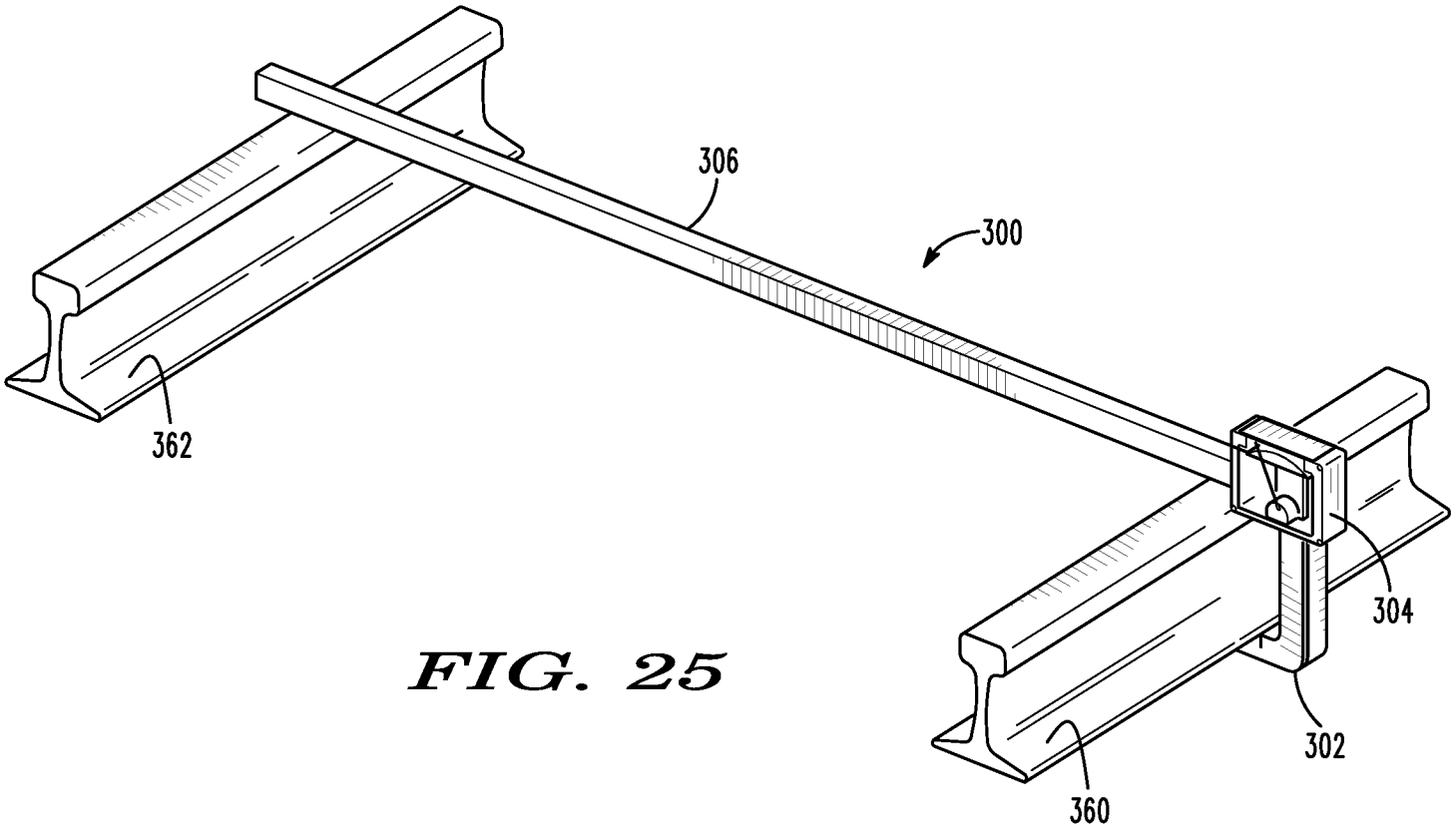
FIG. 25 illustrates a perspective view of a rail cant measurement tool in an alternate embodiment of the present invention.
Figure 26:
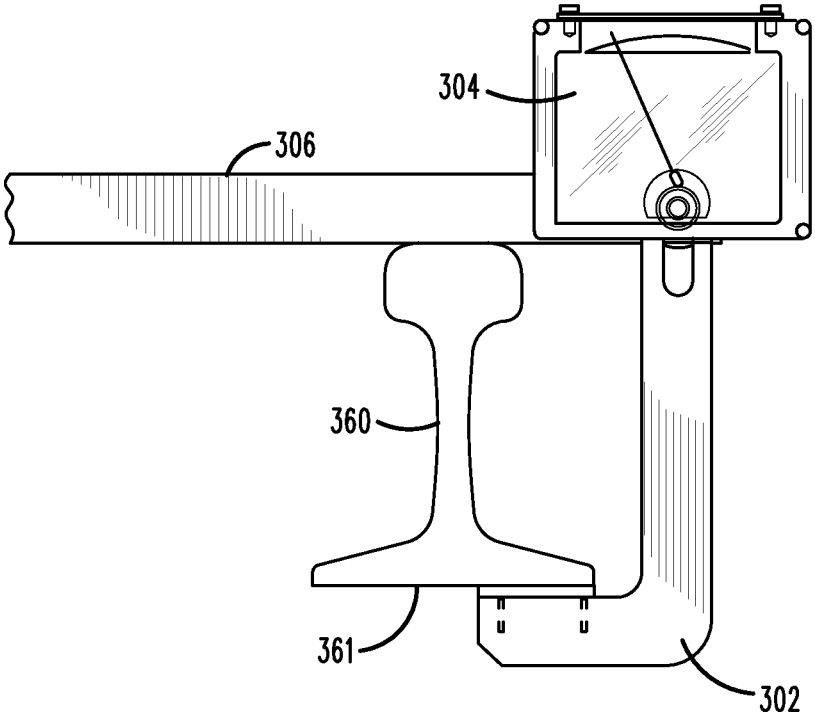
FIG. 26 illustrates a close-up end view of a rail cant measurement to in an alternate embodiment of the present invention.

FIGS. 25 and 26 illustrate yet another embodiment of the present invention of a rail cant measurement tool 300 comprising a rail centerline reference head 302, a measurement gauge 304 and a track plane reference bar 306. Both the measurement gauge 304 and the track plane reference bar 306 may be the same or similar to corresponding components described above with reference to FIGS. 20-24. Rail centerline reference head 302 is illustrated as providing an alternate means for referencing the rail centerline of first rail 360. Specifically, rail centerline reference head 302 may comprise a J-shaped bar that may be rigidly attached, connected or otherwise maintaining rigid contact therewith, such as via tension from a spring or the like, to an underside 361 of the base of the first rail 360, such as using screws, bolts, clamps, springs or other like connecting, contacting or tensioning means. Of course, it should be noted that the rail centerline reference head 302 may be any shape to provide a rigid connection or tension against the underside 361 of the base of the first rail 360. By rigidly attaching, connecting or otherwise maintaining contact by tensioning the rail centerline head 302 to the underside 361 of the base of the first rail 360, the rail centerline of the first rail 360 may be readily proxied by the rail centerline reference head 302.

As illustrated in FIG. 26, the measurement gauge 304 may be rigidly held on the J-shaped bar of the rail centerline head 302 so as to proxy the rail centerline of the first rail 360, with the track plane reference bar 306 rotatably connected to a pin (not shown) that may rotate with the track plane reference bar 306 relative to the rail centerline reference head 302 and provide a measurement of rail cant on the scale within the measurement gauge 304, as described above. Thus, FIGS. 25 and 26 illustrate an alternate embodiment of a rail cant measurement tool, illustrating that there are various ways that rail centerline may be determined by connecting a rail centerline reference head thereto, such as by clamping to the rail web, to the edges of the base of a rail, to the underside of the base of a rail, or to any other part or component of a rail. The present invention should not be limited as described herein.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A rail cant measurement tool for measuring rail cant of a first rail having a base, a rail web and a rail head, the rail cant measurement tool comprising:

a cant angle measurement assembly comprising a frame for disposing over the first rail, said frame having rail engaging means for engaging the first rail and a rail cant indicator; and a track plane reference bar extending from the cant angle measurement assembly and for disposing on an uppermost surface of the first rail and an uppermost surface of a parallel second rail to determine a track reference plane, wherein the rail cant indicator shows rail cant information indicative of the angle between a running surface of the first rail and the track reference plane.

2. The rail cant measurement tool of claim 1 wherein the frame of the cant angle measurement assembly comprises a first leg, a second leg, and a bridge between the first leg and the second leg, wherein when said rail engaging means is engaged with the first rail, the first leg sits adjacent a first side of the rail web, the second leg sits adjacent a second side of the rail web and the bridge sits above the rail head.

3. The rail cant measurement tool of claim 2 wherein the frame comprises a first slot for engaging the base of the first rail.

4. The rail cant measurement tool of claim 2 wherein the first slot is disposed on the first leg for engaging the base of the first rail.

5. The rail cant measurement tool of claim 2 wherein the frame comprises a first slot on the first leg for engaging the base of the first rail and the frame further comprises a second slot on the second leg for engaging the base of the first rail.

6. The rail cant measurement tool of claim 2 wherein the frame comprises a first slot on the first leg and a second slot on the first leg, wherein the first slot and the second slot are engageable with different sized bases of the first rail.

7. The rail cant measurement tool of claim 2 wherein the frame comprises a first slot on the first leg and a second slot on the first leg, and the frame comprises a first slot on the second leg and a second slot on the second leg, wherein the first slots on the first and second legs and the second slots on the first and second legs are respectively engageable to different sized bases of the first rail.

8. The rail cant measurement tool of claim 2 wherein the first leg comprises a first removable foot and the second leg comprises a second removable foot, wherein the first and second removable feet are each engageable with the base of the first rail.

9. The rail cant measurement tool of claim 1 wherein the rail cant indicator comprises a rotary encoder assembly, the rotary encoder assembly being engageable with the running surface of the first rail.

10. The rail cant measurement tool of claim 1 wherein the rotary encoder assembly shows the angle between the running surface of the first rail and the track reference plane.

11. A method for measuring rail cant of a first rail having a base, a rail web and a rail head, the method comprising the steps of:

providing a rail cant measurement tool, the rail cant measuring tool comprising a cant angle measurement assembly comprising a frame for disposing over the first rail, said frame having rail engagement means for engaging the first rail and a rail cant indicator and a track plane reference bar extending from the cant angle measurement assembly and for disposing on an uppermost surface of the first rail and an uppermost surface of a parallel second rail to determine a track reference plane, wherein the rail cant indicator indicating rail cant information indicative of the angle between a running surface of the first rail and track reference plane;

placing the frame over the first rail;

engaging the rail engagement means with the first rail and determining a planar running surface of the first rail;

placing the track plane reference bar on an uppermost surface of the first rail and an uppermost surface of a parallel second rail and determining a track reference plane;

indicating the rail cant on the rail cant indicator.

12. The method of claim 11 wherein the frame comprises a first leg, a second leg and a bridge between the first leg and the second leg, wherein when said frame is placed over the first rail, the first leg sits adjacent a first side of the rail web of the first rail and the second leg sits adjacent the second side of the rail web of the first rail.

13. The method of claim 12 wherein the first leg comprises a first slot, the method further comprising the step of:

engaging the first slot of the first leg with the base of the first rail.

14. The method of claim 13 wherein the second leg comprises a first slot, the method further comprising the step of:

engaging the first slot of the second leg with the base of the first rail.

15. The method of claim 12 wherein the first leg comprises a first slot and a second slot, and the second slot comprises a first slot and a second slot, wherein the first slots of the first and second legs are engageable with a base of the first rail of a first size and the second slots of the first and second legs are engageable with a base of a second size, said method further comprising the steps of:

engaging the first slots of the first and second legs with the base of the first rail if the base of the first rail is of the first size.

16. The method of claim 15 further comprising the step of:

engaging the second slots of the first and second legs with the base of the first rail if the base of the first rail is of the second size.

17. The method of claim 11 wherein the first leg comprises a first removable foot and the second leg comprises a second removable foot, wherein the first and second removable feet each engageable with the base of the first rail, and further comprising the steps of:

engaging the first and second removable feet with the base of the first rail.

18. The method of claim 11 wherein the cant indicator comprises a rotary encoder assembly, the rotary encoder assembly being engageable with the running surface of the first rail.

19. The method of claim 11 further comprising the steps of:

showing the rail cant on the rail cant indicator, wherein the rail cant is measured as the different between the planar running surface of the first rail and the track reference plane.

20. The method of claim 11 further comprising the step of:

showing the rail cant on the rail cant indicator as an absolute value or a relative value.

* * * * *